US011056062B2

(12) United States Patent
Liu et al.

(10) Patent No.: US 11,056,062 B2
(45) Date of Patent: Jul. 6, 2021

(54) DATA LINE COMPENSATION FOR ORGANIC LIGHT EMITTING DISPLAY DEVICE AND DRIVING METHOD THEREOF

(71) Applicant: Xiamen Tianma Micro-Electronics Co., Ltd., Xiamen (CN)

(72) Inventors: Junkai Liu, Shanghai (CN); Yang Yang, Shanghai (CN); Xiangzi Kong, Shanghai (CN); Shuai Yang, Shanghai (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/839,091

(22) Filed: Apr. 3, 2020

(65) Prior Publication Data

US 2020/0234651 A1 Jul. 23, 2020

(30) Foreign Application Priority Data

Dec. 25, 2019 (CN) ..... 201911357591.7

(51) Int. Cl.
*G09G 3/3275* (2016.01)
*G09G 3/3266* (2016.01)
*G09G 3/3225* (2016.01)

(52) U.S. Cl.
CPC ..... *G09G 3/3275* (2013.01); *G09G 3/3266* (2013.01); *G09G 2310/0278* (2013.01)

(58) Field of Classification Search
CPC ..... G09G 2320/045; G09G 3/3241; G09G 3/3233
See application file for complete search history.

(56) References Cited

U.S. PATENT DOCUMENTS

2010/0277400 A1* 11/2010 Jeong ..... G09G 3/3275 345/76
2014/0225883 A1* 8/2014 Chaji ..... G09G 3/3233 345/212

(Continued)

FOREIGN PATENT DOCUMENTS

CN 105243996 A 1/2016
CN 2019-04647 U * 1/2019 ..... G09G 3/3233

(Continued)

*Primary Examiner* — Sepehr Azari
(74) *Attorney, Agent, or Firm* — Kilpatrick Townsend & Stockton, LLP

(57) ABSTRACT

Provided are an organic light emitting display device and a driving method thereof. The display device includes data lines, first detection lines, first compensation detection circuits, a display driving chip, a compensation chip and a control chip. Each data line is electrically connected to a corresponding first detection line through at least one first compensation detection circuit. The display driving chip sends a reference data signal to the data lines in a detection stage. The compensation chip acquires signals collected by the first detection lines and sends the signals to the control chip in the detection stage. The control chip determines a data signal compensation parameter according to the received signals, and controls the display driving chip to provide a display data signal to the data lines in a display stage according to the data signal compensation parameter.

14 Claims, 15 Drawing Sheets

(56) References Cited

U.S. PATENT DOCUMENTS

| | | | | |
|---|---|---|---|---|
| 2019/0122616 | A1* | 4/2019 | Lee | G09G 3/3233 |
| 2019/0180693 | A1* | 6/2019 | Kim | G09G 3/3275 |
| 2020/0135094 | A1* | 4/2020 | Chen | G09G 3/3241 |

FOREIGN PATENT DOCUMENTS

| | | | |
|---|---|---|---|
| CN | 109215569 | A | 1/2019 |
| CN | 110047434 | A | 7/2019 |

* cited by examiner

DATA LINE COMPENSATION FOR ORGANIC LIGHT EMITTING DISPLAY DEVICE AND DRIVING METHOD THEREOF

CROSS-REFERENCES TO RELATED APPLICATIONS

This application claims priority to a Chinese patent application No. 201911357591.7, filed at CNIPA on Dec. 25, 2019, the content of which is incorporated herein by reference in its entirety.

FIELD

The present disclosure relates to a display technology field and, in particular, to an organic light emitting display device and a driving method thereof.

BACKGROUND

Organic light-emitting diode (OLED) display panel possesses advantages of self-emission and large visible angles, and has been widely used. The OLED display panel generally includes multiple pixel units arranged in a matrix. The pixel units display images under the driving of a scanning signal and a data signal.

At present, an organic light emitting display panel having a larger size is typically provided with multiple driving chips to provide data signals to multiple data lines. Among the pixel units arranged in an array, the pixel units in the same column receive the data signal via the same data line, and organic light emitting units in the pixel units are driven to emit light and implement image display. However, data signals provided by data signal output channels of different driving chips are sensitive to a stability of an output voltage. The actually outputted data signals are different. Even if the data signals provided by the output channels of the same driver chip also are different. Therefore, data signals received by pixel units in different columns are different, and the emission luminance values of the organic light emitting units in different columns are different, which leads to uneven display of the organic light emitting display panel.

SUMMARY

The present disclosure provides an organic light emitting display device and a driving method of the organic light emitting display device. With the organic light emitting display device and the driving method, differences among data signal output channels of the organic light emitting display panel are eliminated and display quality of the organic light emitting display panel is improved.

One embodiment of the present disclosure provides an organic light emitting display device, and the organic light emitting display device includes multiple data lines, multiple first detection lines, multiple first compensation detection circuits, a display driving chip, a compensation chip, and a control chip.

Each of the multiple data lines is electrically connected to a respective one of the multiple first detection lines through at least one of the multiple first compensation detection circuits.

The multiple the data lines are electrically connected to the display driving chip. The multiple first detection lines are electrically connected to the compensation chip. The control chip is electrically connected to the display driving chip and the compensation chip separately.

The display driving chip is configured to provide a reference data signal to the multiple data lines in a detection stage.

The compensation chip is configured to acquire signals collected by the multiple first detection lines and send the signals to the control chip in the detection stage. The control chip is configured to determine a data signal compensation parameter according to the signals collected by the multiple first detection lines, and control the display driving chip to provide a display data signal to the multiple data lines in a display stage according to the data signal compensation parameter.

Another embodiment of the present disclosure further provides a driving method of an organic light emitting display device, which is applicable to the organic light emitting display device in the above embodiment, and the method includes the following steps.

A display driving chip sends a reference data signal to multiple data lines in a detection stage.

The compensation chip acquires signals collected by multiple first detection lines in the detection stage and sends the signals to a control chip.

The control chip determines a data signal compensation parameter according to the signals collected by the multiple first detection lines, and controls the display driving chip to provide a compensation data signal to the multiple data lines in a display stage according to the data signal compensation parameter.

According to the organic light emitting display device and the driving method provided by the embodiment of the present disclosure, multiple data lines, multiple first detection lines, multiple first compensation detection circuits, a display driving chip, a compensation chip, and a control chip are arranged; each of the multiple data lines is electrically connected to a respective one of the multiple first detection lines through at least one of the multiple first compensation detection circuits; the multiple first detection lines are electrically connected to the compensation chip; the control chip is electrically connected to the display driving chip and the compensation chip separately; the display driving chip is configured to provide a reference data signal to the multiple data lines in a detection stage; the compensation chip is configured to acquire signals collected by the multiple first detection lines and send the signals to the control chip in the detection stage; and the control chip is configured to determine a data signal compensation parameter according to the signals collected by the multiple first detection lines, and control the display driving chip to provide a display data signal to the multiple data lines in a display stage according to the data signal compensation parameter. The present disclosure solves the problem of data signal variation of the driving chip, and realizes data signal compensation. The organic light-emitting display device provided by the embodiment of the present disclosure can reduce the data signal variation on each data line, avoid uneven brightness of the display panel, ensure that each column of pixel units has the same gray standard, and improve the display quality.

DETAILED DESCRIPTION

Figure 1:
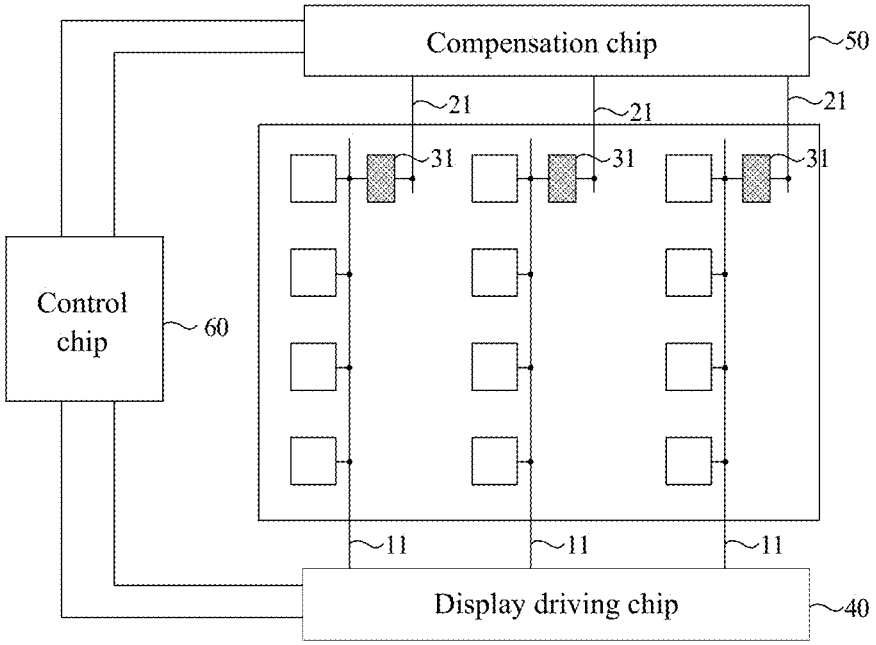
FIG. 1 is a structural schematic diagram of an organic light emitting display device according to an embodiment of the present disclosure.

The present disclosure will be further described in detail in conjunction with the drawings and embodiments. It is to be understood that the embodiments set forth below are intended to illustrate and not to limit the present disclosure. Additionally, it is to be noted that, for ease of description, only part, not all, of the structures related to the present disclosure are illustrated in the drawings.

FIG. 1 is a structural diagram of an organic light emitting display device according to an embodiment of the present disclosure. Referring to FIG. 1, the organic light emitting display device includes multiple data lines 11, multiple first detection lines 21, multiple first compensation detection circuits 31, a display driving chip 40, a compensation chip 50, and a control chip 60. Each of the multiple data lines 11 is electrically connected to a respective one of the multiple first detection lines 21 through at least one of the multiple first compensation detection circuits 31. The multiple the data lines 11 are electrically connected to the display driving chip 40. The multiple first detection lines 21 are electrically connected to the compensation chip 50. The control chip 60 is electrically connected to the display driving chip 40 and the compensation chip 50 separately.

The display driving chip 40 is configured to provide a reference data signal to the multiple data lines 11 in a detection stage. The compensation chip 50 is configured to acquire signals collected by the multiple first detection lines 21 and send the signals to the control chip 60 in the detection stage. The control chip 60 is configured to determine a data signal compensation parameter according to the signals collected by the multiple first detection lines 21, and control the display driving chip 40 to provide a display data signal to the multiple data lines 11 in a display stage according to the data signal compensation parameter.

In the organic light emitting display device, multiple pixel units are defined by crossing of multiple data lines 11 and multiple scanning lines (not shown). The pixel unit includes a light emitting unit. The data line and the scanning line provide a driving signal to the pixel unit in a display stage, and the light emitting unit emits light, to implement the image display. In the existing organic light-emitting display panel, the display driving chip 40 provides a data signal through the data line 11 in the display stage. In the actual driving display process, the data signal actually outputted by the display driving chip 40 is not exactly the same as the target data signal due to poor voltage stability. In the organic light emitting display device provided above, the first compensation detection circuit 31 is connected to the first detection line 21 and the data line 11, and can send the data signal at a connection node of the data line 11 to the compensation chip 50, to implement the data signal detection. The control chip 60 is configured to compensate the data signal actually provided in the display stage according to the data signal provided by the compensation chip 50 in the detection stage. It can be understood that the quantity of the display driving chip 40 and the quantity of the compensation chip 50 may not be limited to one. In one or more embodiments, according to actual needs, multiple display driving chips 40 and multiple compensation chip 50 may be provided to drive the pixel unit and compensate detection.

Figure 2:
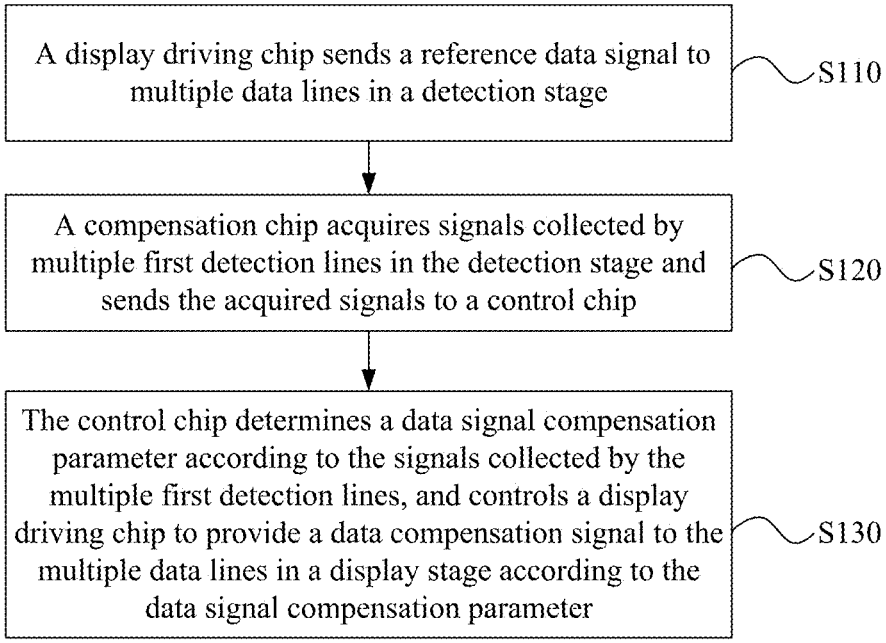
FIG. 2 is a flowchart of a driving method of an organic light emitting display device according to an embodiment of the present disclosure.

FIG. 2 is a flowchart of a driving method of an organic light emitting display device according to an embodiment of the present disclosure. Referring to FIGS. 1 and 2, the specific driving method is explained. The driving method includes the steps described below.

In S110, a display driving chip 40 provides a reference data signal to multiple data lines 11 in a detection stage.

In S120, the compensation chip 50 acquires signals collected by multiple first detection lines 21 in the detection stage and sends the signals to a control chip 60.

In S130, the control chip 60 determines a data signal compensation parameter according to the signals collected by the multiple first detection lines 21, and controls the display driving chip 40 to provide a compensation data signal to the multiple data lines 11 in a display stage according to the data signal compensation parameter.

In one embodiment, when the actual data signal detected in the detection stage is different from the reference data signal, the target data signal is appropriately compensated based on the difference value target data signal when the display driving chip 40 is actually controlled to provide the data signal to the data line 11. Exemplarily, when the actual data signal detected in the detection stage is smaller than the reference data signal, the data signal value outputted when the display driving chip 40 is actually controlled to provide the data signal to the data line 11 may be appropriately increased, so the actual data signal approaches the target data signal.

It should be noted that, in the actual display stage, due to the randomness of the display image, the data signals sent by the data signal output channels of the display driving chip 40 to the data lines 11 are different. In the embodiment of the present disclosure, the first detection line 21, the first compensation detection circuit 31, the compensation chip 50, and the control chip 60 are used for compensating the data signal to reduce the output variation of each data signal output channel rather than making the data signal of each data line in the display stage be the same. The present disclosure the first detection line 21, the first compensation detection circuit 31, the compensation chip 50, and the control chip 60 are configured in such a manner that for each output channel, the actually outputted data signal and the target data signal have a synchronized and consistent deviation, or the actually outputted data signal is equal to the target data signal, and each pixel unit of the organic display device has the same gray level, and the display screen has even brightness.

It is also to be noted that the process of providing the reference data signal to the data line 11 to realize the data signal detection is in the detection stage. Usually, the detection stage may be set at the non-display stage of the organic light emitting display device. Taking the display panel being applied in a television as example, the detection stage may be set in the power-on stage of the television or the power-off stage of the television, and the data signal compensation can be achieved in this power-on working sequence of the television or in next power-on working sequence of the television. However, in the display stage, it needs to send the data signal to the data line 11 for the driving the pixel unit. Therefore, the detection stage of the data signal compensation may be set in the display stage, i.e., the data signal in the display driving process can serve as the reference data signal and be compared with the actually detected data signal to obtain the data signal compensation parameter, which facilitates subsequent data signal compensation.

In the organic light emitting display device provided by the embodiment of the present disclosure, multiple data lines, multiple first detection lines, multiple first compensation detection circuits, the display driving chip, the compensation chip, and the control chip are configured; each of the multiple data lines is electrically connected to a respective one of the multiple first detection lines through at least one of the multiple first compensation detection circuits; the multiple first detection lines are electrically connected to the compensation chip; the control chip is electrically connected to the display driving chip and the compensation chip separately; the display driving chip is configured to provide a reference data signal to the multiple data lines in a detection stage; and the compensation chip is configured to acquire signals collected by the multiple first detection lines and send the signals to the control chip in the detection stage; and the control chip is configured to determine a data signal compensation parameter according to the signals collected by the multiple first detection lines, and control the display driving chip to provide a display data signal to the multiple data lines in a display stage according to the data signal compensation parameter. The present disclosure solves the problem of variation of each data signal output channel of the driving chip, and realizes compensation of data signal output difference. The organic light-emitting display device provided by the embodiment of the present disclosure can reduce the variation of the data signal on each data line, avoid uneven brightness of the display panel, ensure that each column of pixel units has the same gray standard, and improve the display quality.

Figure 3:
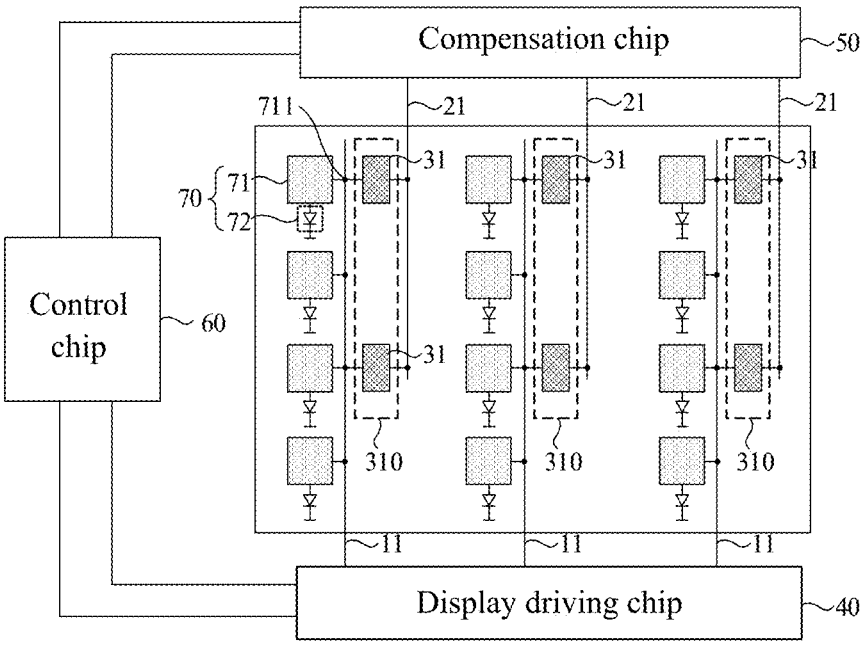
FIG. 3 is a structural schematic diagram of another organic light emitting display device according to an embodiment of the present disclosure.

On the basis of the above embodiment, different positions on the data line have a certain voltage drop due to the impedance of the data line, that is, the data signal voltage decreases as the distance with respect to the display driving chip increases. As a result, the light-emitting units in a same column driven and by the data line have different light-emitting intensities, causing the display brightness of the display panel to be uneven. Based on this, an embodiment of the present disclosure also provides an organic light emitting display device. FIG. 3 is a structural diagram of another organic light emitting display device according to an embodiment of the present disclosure. Referring to FIG. 3, the organic light emitting display device includes multiple pixel units 70 arranged in an array. Each pixel unit 70 includes a pixel driving circuit 71 and an organic light emitting element 72. The pixel driving circuits 71 of the pixel units 70 in the same column are electrically connected to the same data line 11. The connection node between the pixel driving circuit 71 and the data line 11 is referred to as a first node 711.

The multiple first compensation detection circuits 31 are arranged in an array. The first compensation detection circuits 31 in a same column are a first compensation detection circuit group 310. Each first compensation detection circuit 31 in the first compensation detection circuit group 310 is electrically connected to the first node 711 of the pixel driving circuit 71 which is in a same column but a different row as the first compensation detection circuit 31.

Exemplarily, when one pixel driving circuit column includes 2n pixel driving circuits 71, n first compensation detection circuits 31 may be arranged correspondingly, that is, each first compensation detection circuit 31 tests the data signal of the first node 711 of one pixel driving circuit 71 at intervals. When display driving is performed in the display stage, and data signal compensation is performed on two adjacent pixel driving circuits 71, the data signal compensation is performed according to the data signal compensation parameter obtained by the first node 711 in one of the two adjacent pixel driving circuits 71. In this case, the first compensation detection circuits 31 are provided at different positions on the same data line 11 so that the data signals at different positions may be detected to compensate each pixel driving circuit when the pixel units in the same column are driven to display, ensuring each pixel driving circuit to obtain a more accurate data signal.

In some embodiments, the number of the first compensation detection circuits 31 in the same column to prevent the first compensation detection circuits 31 from occupying too much display area of the organic light-emitting display device, or may correspondingly configure one first compensation detection circuit 31 for each pixel driving circuit 71 to ensure the accuracy of the data signal provided by the display driving chip 40 to each pixel driving circuit 71.

Figure 4:
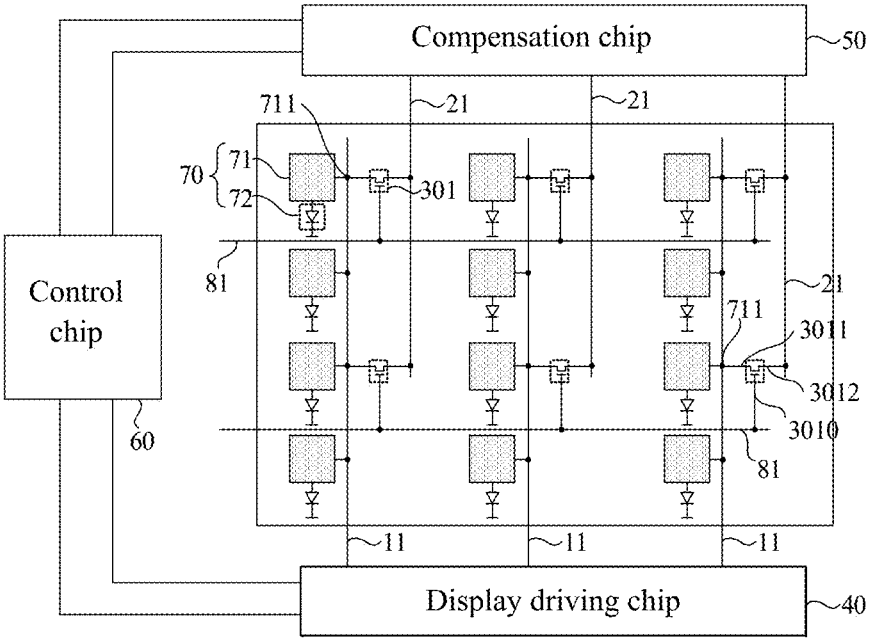
FIG. 4 is a structural schematic diagram of another organic light emitting display device according to an embodiment of the present disclosure.

When multiple first compensation detection circuits 31 are connected to the same data line 11, the compensation chip 50 needs to distinguish between the first compensation detection circuits 31 in the same column. FIG. 4 is a structural diagram of another organic light emitting display device according to an embodiment of the present disclosure. Referring to FIG. 4, the organic light-emitting display device may further include multiple first detection scanning signal lines 81, and each of the multiple first compensation detection circuits includes a first switch unit 301. Control ends 3010 of the first switch units 301 of the first compensation detection circuits in a same row are connected to a same first detection scanning signal line 81; input ends 3011 of the first switch units 301 are electrically connected to the first nodes 711; output ends 3012 of the first switch units 301 are electrically connected to the first detection lines 21.

Figure 19:
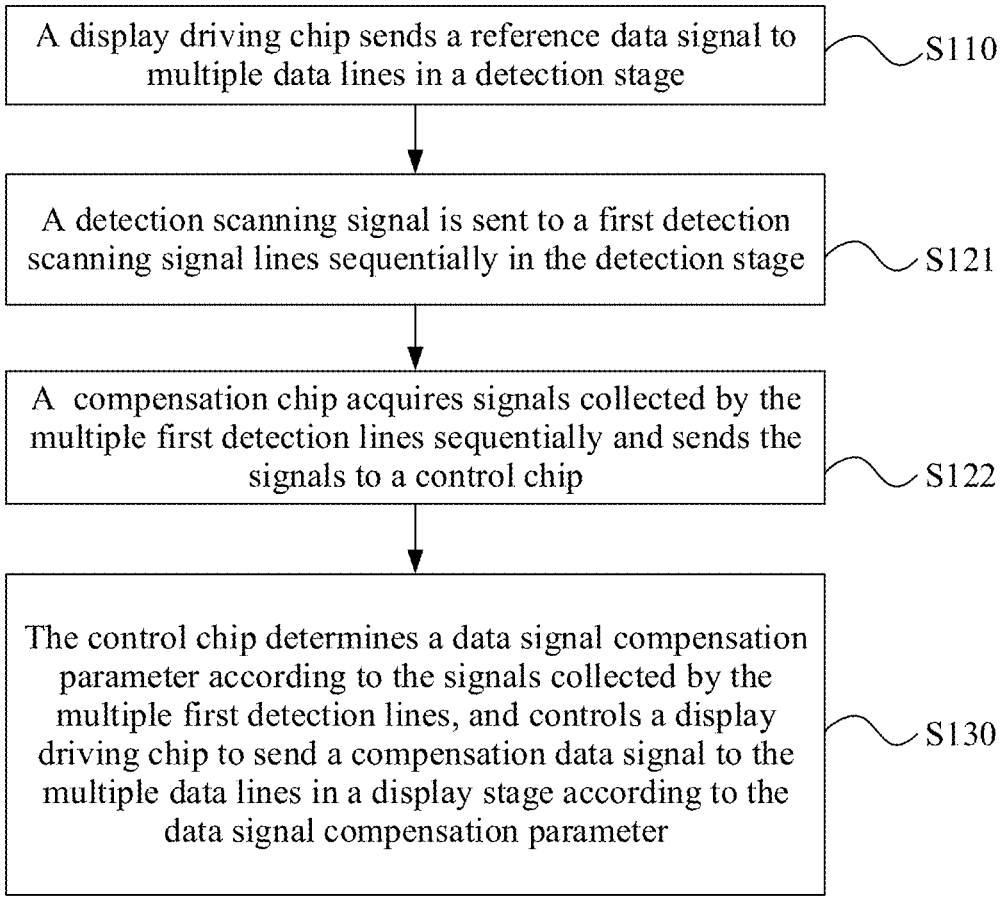
FIG. 19 is a flowchart of another driving method of an organic light emitting display device according to an embodiment of the present disclosure.

The first switch unit 301 may be a thin film transistor. A source electrode and a drain electrode of the thin film transistor are the input end 3011 and the output end 3012 of the first switch unit 301 respectively. A gate electrode of the thin film transistor is the control end 3010 of the first switch unit 301. Referring to FIG. 19, the method for driving the organic light emitting display device includes the following steps.

In S110, a display driving chip 40 sends a reference data signal to multiple data lines in a detection stage.

In S121, a detection scanning signal is sent to the first detection scanning signal lines 81 sequentially in the detection stage.

In S122, the compensation chip 50 acquires signals collected by the multiple first detection lines 21 sequentially and sends the signals to the control chip 60.

In S130, the control chip determines a data signal compensation parameter according to the signals collected by the multiple first detection lines 21, and controls the display driving chip 40 to send a compensation data signal to the multiple data lines 11 in a display stage according to the data signal compensation parameter.

The detection scanning signal of the first detection scanning signal line 81 is essentially a control signal of the first switch unit 301, and is used for turning on the first switch units 301 in the same row at the same time. The compensation chip 50 may determine the first compensation detection circuit 31 to which the data signal detected on the same detection line 21 belongs according to the detection scanning signal timing sequence provided on the first detection scanning signal lines 81. Exemplarily, when the control signal is provided on the first detection scanning signal line 81 in a n-th row and no control signal is provided on other first detection scanning signal lines 81, the data signals detected by the detection lines 21 are actually the data signals detected by the first compensation detection circuits 31 in the n-th row.

Each of the first detection scanning signal lines 81 shown in FIG. 4 may be electrically connected to the compensation chip 50, i.e., on-off of each first switch unit 301 is controlled by the compensation chip 50. In one embodiment, an additional scanning driving circuit or chip may be provided and connected to the first detection scanning line 81, and the compensation chip 50 or the control chip 60 controls the scanning driving circuit or chip to provide the detection scanning signal.

Figure 5:
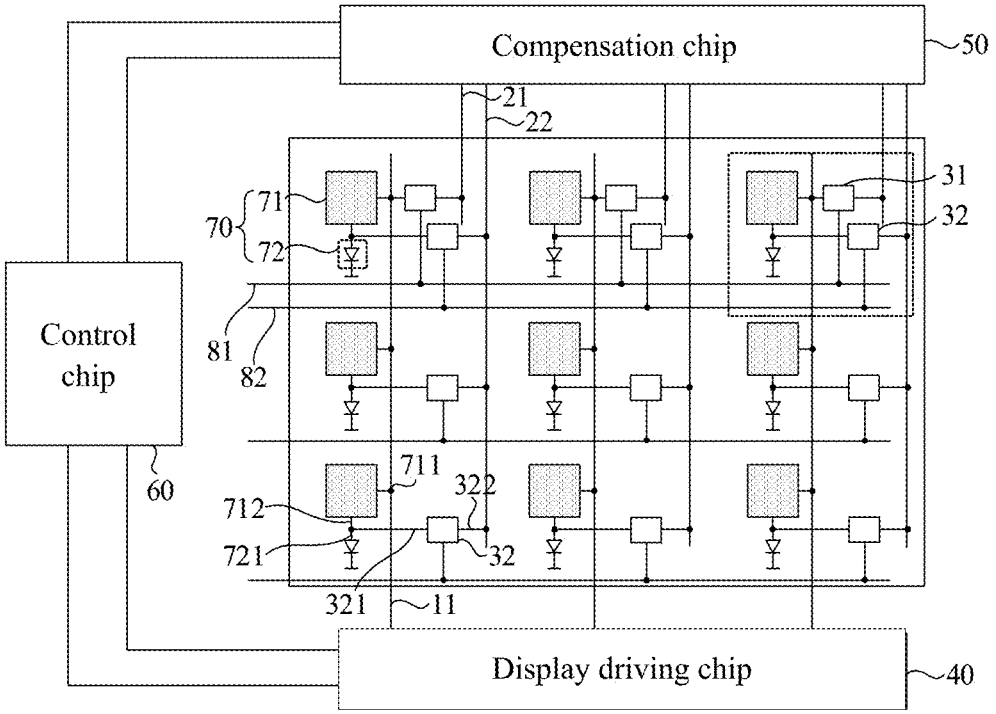
FIG. 5 is a structural schematic diagram of another organic light emitting display device according to an embodiment of the present disclosure.

Based on the above embodiments, an embodiment of the present disclosure further provides an organic light emitting display device. FIG. 5 is a structural diagram of another organic light emitting display device according to an embodiment of the present disclosure. Referring to FIG. 5, in the organic light emitting display device, each pixel unit 70 includes a pixel driving circuit 71 and an organic light emitting element 72. An output end 712 of the pixel driving circuit 71 is electrically connected to an anode 721 of the organic light emitting element 72. Pixel driving circuits 71 of the pixel units 70 in the same column are electrically connected to the same data line 21.

The organic light emitting display device further includes multiple second compensation detection circuits 32 and multiple second detection lines 22. Output ends 712 of multiple pixel driving circuits 71 are electrically connected to first ends 321 of the multiple second detection lines 32 in one-to-one correspondence. Second ends 322 of the second compensation detection circuits 32 electrically connected to the output ends 712 of the pixel driving circuits 71 in the same column are connected to a same second detection line 22.

The multiple second detection lines 22 are electrically connected to the compensation chip 50. The compensation chip 50 is further configured to acquire the signals collected by the multiple second detection lines 22 in the detection stage and send the signals to the control chip 60. The control chip 60 determines the data signal compensation parameter according to the signals collected by the first detection lines 21 and the signals collected by the multiple second detection lines 22, and controls the display driving chip 40 to provide the display data signal to the multiple data lines 11 in the display stage according to the data signal compensation parameter.

Figure 6:
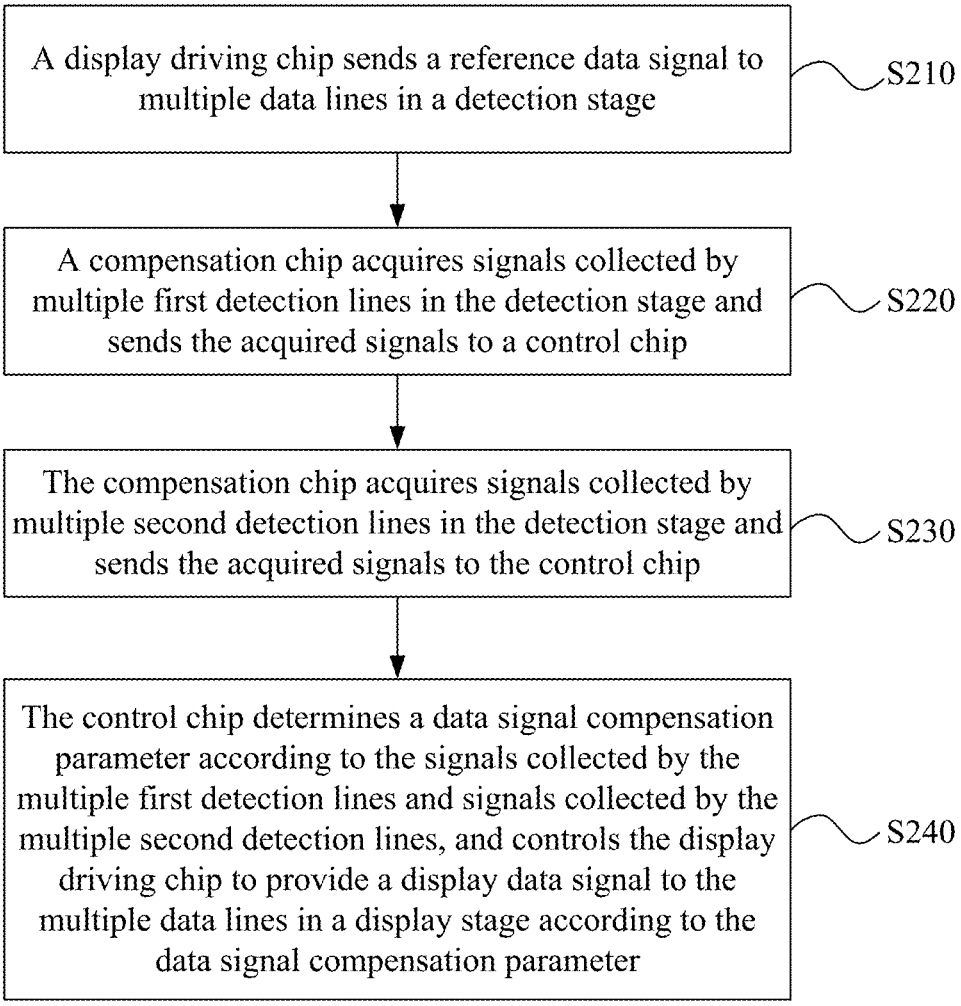
FIG. 6 is a flowchart of a driving method of an organic light emitting display device according to an embodiment of the present disclosure.

The second compensation detection circuit 32 is connected to the pixel driving circuit 71 and the second detection line 22, and may detect the signal actually outputted by the pixel driving circuit 71 to the organic light emitting element 72. In one embodiment, for the organic light emitting display device shown in FIG. 5, an embodiment of the present disclosure further provides a driving method of the organic light emitting display device. FIG. 6 is a flowchart of a driving method of an organic light emitting display device according to an embodiment of the present disclosure. Referring to FIGS. 5 and 6, the driving method includes the steps described below.

In S210, the display driving chip 40 sends a reference data signal to multiple data lines in a detection stage.

In S220, the compensation chip 50 acquires signals collected by the multiple first detection lines 21 in a detection stage and sends the signals to the control chip 60.

In S220, the compensation chip 50 acquires signals collected by the multiple second detection lines 22 in the detection stage and sends the signals to the control chip 60.

In S240, the control chip 60 determines a data signal compensation parameter according to the signals collected by the first detection lines 21 and the signals collected by the multiple second detection lines 22, and controls the display driving chip 40 to provide a display data signal to the multiple data lines 11 in a display stage according to the data signal compensation parameter.

In this case, the compensation chip 50 may determine the working performance of the corresponding pixel driving circuit through the actual output signal provided by the second compensation detection circuit 32 to compensate for the working performance change of the pixel driving circuit, so that the signal actually outputted by the organic light emitting element 72 to the pixel driving circuit 71 is more closer to the target output signal, ensuring the display accuracy and improving the display quality.

Figure 7:
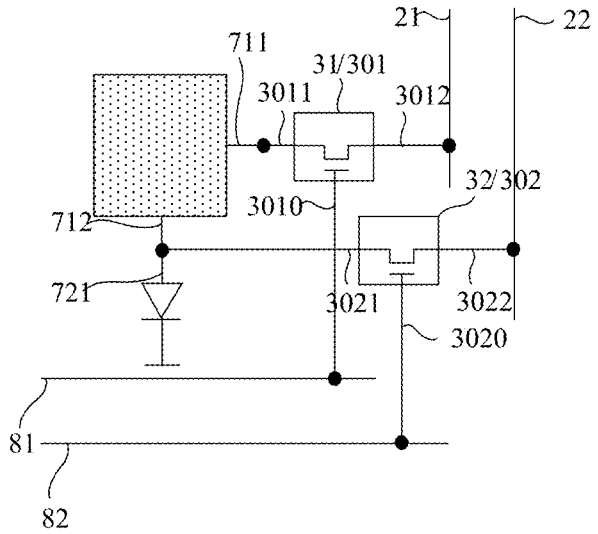
FIG. 7 is an enlarged view of a part of an organic light emitting display device in a dotted box shown in FIG. 5.

In the organic light-emitting display device shown in FIG. 5, since multiple second compensation detection circuits 32 are connected to one second detection line 22 connected to the compensation chip 50 at the same time, the compensation chip 50 needs to distinguish between the second compensation detection circuits 32 in the same column. FIG. 7 is a partially enlarged view of a dotted box of the organic light emitting display device shown in FIG. 5. Referring to FIGS. 5 and 7, the organic light-emitting display device may further include multiple first detection scanning signal lines 81, and each first compensation detection circuit includes a first switch unit 301. The control ends 3010 of the first switch units 301 of the first compensation detection circuits in a same row are connected to a same first detection scanning signal line 81. The input ends 3011 of the first switch units 301 are electrically connected to the first nodes 711. The output ends 3012 of the first switch units 301 are electrically connected to the first detection lines 21.

The organic light emitting display device further includes multiple second detection scanning signal lines 82, and each second compensation detection circuit 32 includes a second switch unit 302. The control ends 3020 of the second switch units 302 of the second compensation detection circuits 32 in a same row are connected to a same second detection scanning signal line 82. A first end 3021 of the second switch unit 302 is a first end 321 of the second compensation detection circuit 32; and a second end 3022 of the second switch unit 302 is a second end 322 of the second compensation detection circuit 32.

In this case, the second switch units 302 in the same row provide control signals through the same second detection scanning signal line 82. When the second switch unit 302 is turned on, the second detection line 21 may detect the actual output signal provided by the pixel driving circuit 71 to the organic light emitting element 72 through the second compensation detection circuit 32. In one embodiment, during the driving process of the organic light emitting display device shown in FIG. 5, the step S230, before the compensation chip 50 acquires the signals collected by the multiple second detection lines 22 in the detection stage and sends the signals to the control chip 60, further includes: sequentially sending a detection scanning signal to the second detection scanning signal lines in the detection stage. Through sequentially sending the detection scanning signal to the second detection scanning signal lines 82, i.e., controlling the second switch units 302 in each row to be turned on sequentially, the compensation chip 50 obtains the actual output signals provided by the pixel driving circuits 71 in the same column to the organic light-emitting elements in the time division manner, so that the performance change of each pixel driving circuit 71 may be compensated.

Figure 8:
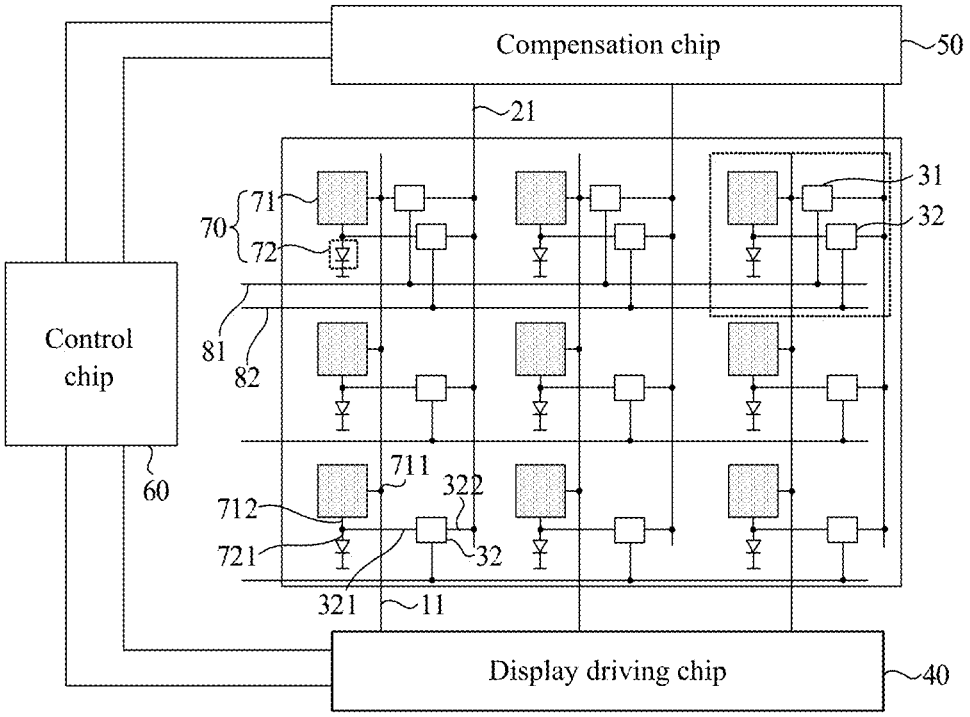
FIG. 8 is a structural diagram of another organic light emitting display device according to an embodiment of the present disclosure.

Further, when the first compensation detection circuit and the second compensation detection circuit are configured, the corresponding detection lines may be shared. FIG. 8 is a structural diagram of another organic light emitting display device according to an embodiment of the present disclosure. Referring to FIG. 8, in the organic light emitting display device, each pixel unit 70 includes a pixel driving circuit 71 and an organic light emitting element 72, and an output end 712 of the pixel driving circuit 71 is electrically connected to an anode 721 of the organic light emitting element 72.

The pixel driving circuits 71 of the pixel units 70 in the same column are electrically connected to the same data line 11. The organic light emitting display device further includes multiple second compensation detection circuits 32. Output ends 712 of the multiple pixel driving circuits 71 are electrically connected to first ends 321 of the multiple second detection lines 32 in one-to-one correspondence. Second ends 322 of second compensation detection circuits 32 electrically connected to the output ends 712 of the pixel driving circuits 71 in the same column are connected to a same second detection line 21.

The detection stage includes a first detection stage and a second detection stage. The compensation chip 50 is configured to acquire the signals collected by the multiple first detection lines 21 in the first detection stage and send the signals to the control chip 60. The compensation chip 50 is further configured to acquire the signals collected by the multiple first detection lines 21 in the second detection stage and send the signals to the control chip 60. The control chip 60 is configured to acquire the signals collected by the multiple first detection lines 21 in the first detection stage, acquire the signals collected by the multiple first detection lines 21 in the second detection stage, determine the data signal compensation parameter, and control the display driving chip 40 to send the display data signal to the multiple the data lines 11 in the display stage according to the data signal compensation parameter.

The first detection line 21 is connected to the first compensation detection circuit 31 and the second compensation detection circuit 32 in the same column at the same time. The first detection line 21 sends the actual data signal of the first compensation detection circuit 31 and the actual data signal acquired by the second compensation detection circuit 32 to the compensation chip 50 through the first detection line 21. The compensation chip 50 may compensate the corresponding pixel driving circuit 71 in the display stage according to the actual data signal and the actual output signal, so that the pixel driving circuit 71 provides the accurate data signal and output signal to the organic light emitting elements 72 to ensure that each organic light emitting element 72 displays according to the target brightness.

Figure 9:
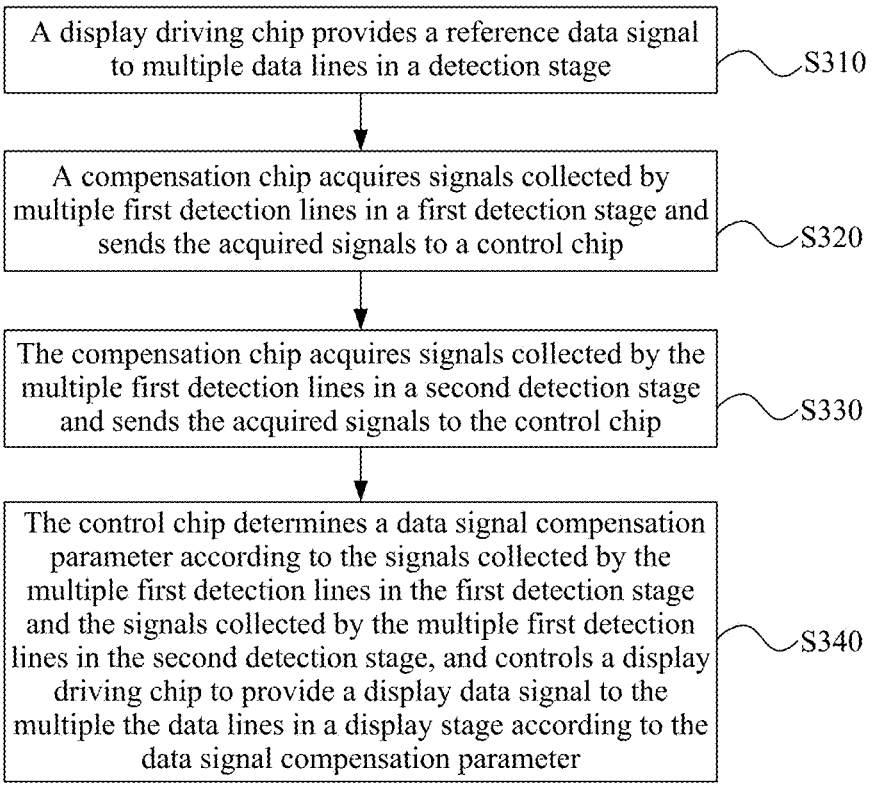
FIG. 9 is a flowchart of another driving method of an organic light emitting display device according to an embodiment of the present disclosure.

In one embodiment, for the organic light emitting display device shown in FIG. 8, an embodiment of the present disclosure further provides a driving method of the organic light emitting display device. FIG. 9 is a flowchart of a driving method of another organic light emitting display device according to an embodiment of the present disclosure. Referring to FIG. 9, the driving method includes the steps described below.

In S310, the display driving chip 40 provides a reference data signal to the multiple data lines 11 in the detection stage.

In S320, the compensation chip 50 acquires signals collected by the multiple first detection lines 21 in the first detection stage and sends the signals to the control chip 60.

In S330, the compensation chip 50 acquires signals collected by the multiple first detection lines 21 in the second detection stage and sends the signals to the control chip 60.

In S340, the control chip 60 determines a data signal compensation parameter according to the signals collected by the multiple first detection lines 21 in the first detection stage and the signals collected by the multiple first detection lines 21 in the second detection stage, and controls the display driving chip 40 to provide the display data signal to the multiple the data lines 11 in the display stage according to the data signal compensation parameter.

Figure 10:
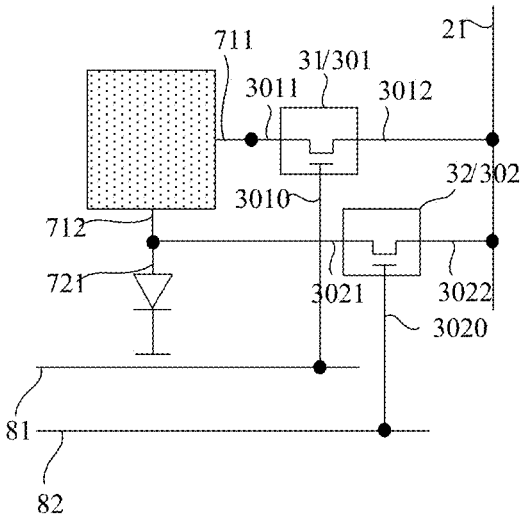
FIG. 10 is an enlarged view of a part of an organic light emitting display device in a dotted box shown in FIG. 8.

Of course, since each first detection line 21 is connected to at least one first compensation detection circuit 31 and multiple second compensation detection circuits 32 at the same time, the compensation chip 50 needs to distinguish between the second compensation detection circuits 32 when receiving a detection signal. FIG. 10 is a partially enlarged view of a dotted box of an organic light emitting display device shown in FIG. 8. Referring to FIG. 8 and FIG. 10, the organic light-emitting display device may further include multiple first detection scanning signal lines 81. Each of the multiple first compensation detection circuits 31 includes a first switch unit 301. Control ends 3010 of the first switch units 301 of the first compensation detection circuits 31 in a same row are connected to a same first detection scanning signal line 81. An input end of the first switch unit 301 is electrically connected to the first node 711. An output end 3012 of the first switch unit 301 is electrically connected to the first detection line 21.

The organic light emitting display device further includes multiple second detection scanning signal lines 82. Each second compensation detection circuit 32 includes a second switch unit 302. Control ends 3020 of the second switch units 302 of the second compensation detection circuits 32 in a same row are connected to a same second detection scanning signal line 82. A first end 3021 of the second switch unit 302 is a first end 321 of the second compensation detection circuit 32; and a second end 3022 of the second switch unit 302 is a second end 322 of the second compensation detection circuit 32.

Figure 20:
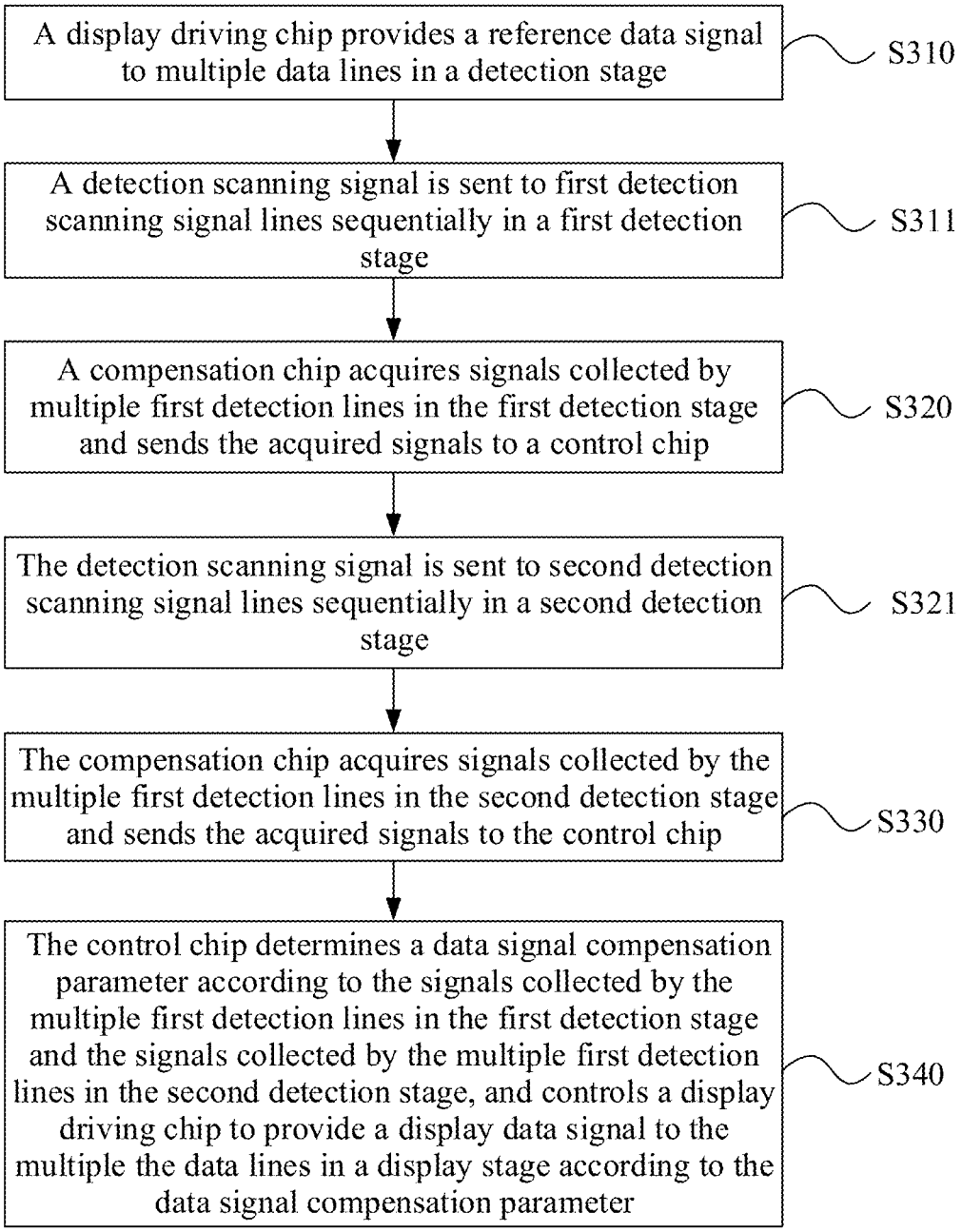
FIG. 20 is a flowchart of another driving method of an organic light emitting display device according to an embodiment of the present disclosure.

The first detection scanning signal line 81 controls on-off of the first compensation detection circuits 31 in the same row. The second detection scanning signal line 82 controls the on-off of the second compensation detection circuits 32 in the same row. In the driving method shown in FIG. 9, before step S320 in which the compensation chip 50 acquires the signals collected by the multiple first detection lines 21 in the first detection stage and sends the signals to the control chip 60, referring to FIG. 20, the method further includes step S311.

In S311, a detection scanning signal is sent to the first detection scanning signal lines 81 sequentially in the first detection stage.

In S330, before the compensation chip 50 acquires signals collected by the multiple first detection lines 21 in the second detection stage and sends the signals to the control chip 60, the method further includes step S321.

In S321, the detection scanning signal is sent to the second detection scanning signal lines 82 sequentially in the second detection stage.

It can be seen that in the first detection stage, each of the first detection scanning signal lines 81 sequentially transmits the detection scanning signal, i.e., each row of first compensation detection circuits 31 is turned on sequentially, and the compensation chip 50 acquires the actual data signals of the pixel driving circuits 71 detected by the detection circuits 31 in each row sequentially, to provide compensation for display driving for the control chip 60. In the second detection stage, each of the second detection scanning signal lines 82 sequentially transmits the detection scanning signal, i.e., each row of second compensation detection circuits 32 is turned on sequentially, and the compensation chip 50 acquires the actual data signals of the pixel driving circuits 71 detected by the second compensation detection circuits 32 in each row sequentially, to provide compensation for display driving for the control chip 60.

It is to be noted that when the output signal sent by the pixel driving circuit 71 to the organic light emitting element 72 is detected by the second compensation detection circuit 32, the pixel driving circuit 71 needs to be turned on, i.e., ensuring the normal operation of the pixel driving circuit 71. Therefore, in the second detection stage in which the detection scanning signal is sequentially sent to the second detection scanning signal lines 82, a light emitting driving signal is sent to the pixel driving circuit 71. In one embodiment, the light emitting driving signal includes a data signal, a scanning signal and a power voltage signal, and the like.

Figure 11:
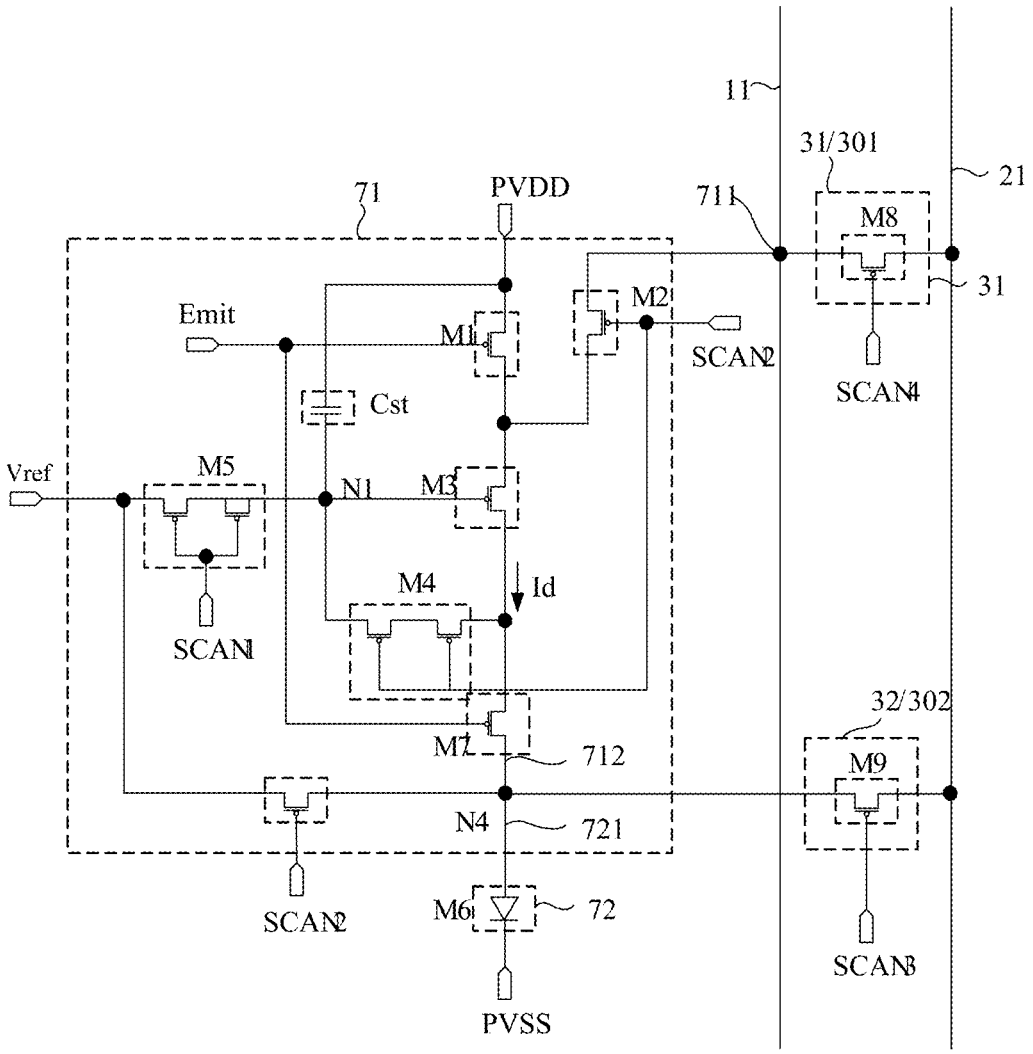
FIG. 11 is a circuit diagram of the dotted box shown in FIG. 8.
Figure 12:
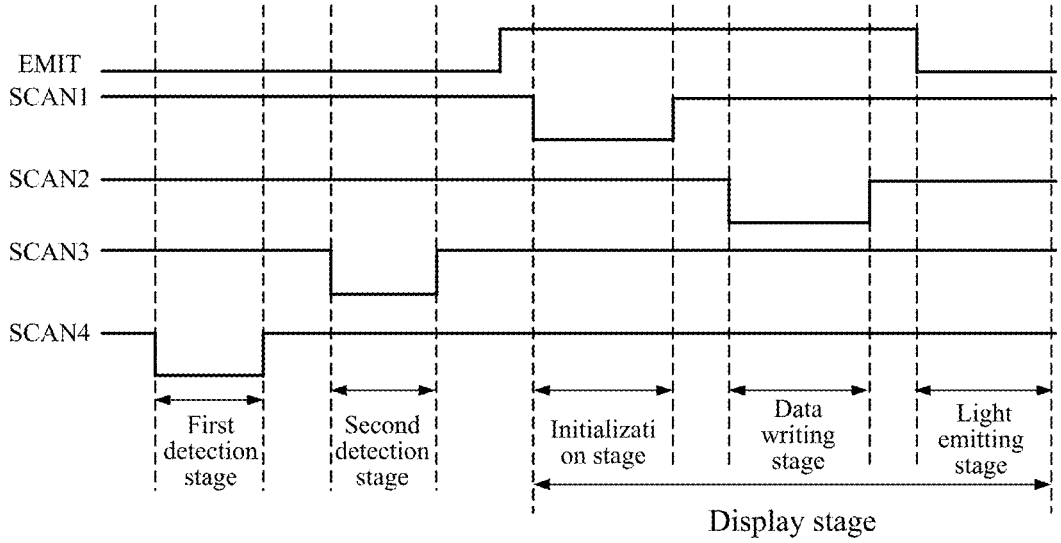
FIG. 12 is a timing sequence diagram of a driving method of a circuit structure shown in FIG. 11.

FIG. 11 is a circuit diagram of a dotted box shown in FIG. 8. FIG. 12 is a timing sequence diagram of a driving method of a circuit structure shown in FIG. 11. Referring to FIGS. 8, 11 and 12, a 7T1C pixel driving circuit is taken as an example, and the timing sequence of the driving method of the organic light emitting display device provided by the embodiment of the present disclosure is described in detail. The 7T1C pixel driving circuit shown in FIG. 11 may include: a first light-emitting control transistor M1, a data signal writing transistor M2, a driving transistor M3, an additional transistor M4, a storage cell reset transistor M5 (i.e., a first reset transistor M5), a second light-emitting control transistor M6, a light-emitting reset transistor M7 (i.e., a second reset transistor M7), and a first detection transistor M8, a second detection transistor M9 and a storage capacitor Cst. The storage cell reset transistor M5 and the additional transistor M4 use double-gate transistors to reduce leakage current and improve the control accuracy of the driving current of the pixel driving circuit, which is conducive to improving the control accuracy of the light-emitting brightness of the light-emitting element.

In FIG. 11, "SCAN1" denotes a first scanning signal provided by a first scanning line (not shown), "SCAN2" denotes a second scanning signal provided by a second scanning line (not shown), and "Emit" denotes a light emission control signal line (not shown), "Vdata" denotes a data signal provided by the data line 11, "Vref" denotes a reference voltage signal provided by a reference voltage line (not shown), "PVDD" denotes a first power resource signal provided by a first power resource signal line (not shown), "PVEE" denotes a second power resource signal used for forming a current loop of the light-emitting element, "SCAN3" denotes the detection scanning signal provided by the second detection scanning signal line 82, and "SCAN4" denotes the detection scanning signal provided by the first detection scanning signal line 81.

In one embodiment, as shown in the figure, the 7T1C pixel driving circuit 71 drives the organic light emitting element 72 to display. The a display stage includes three sub stages, which are an initialization stage, a data writing stage, and a light-emitting stage. Referring to FIG. 12, the working principle of the organic light emitting display device is described with an example in which transistors M1-M7 as P-type transistors and the reference voltage signal Vref is a low-level signal.

At the initialization stage: the first scanning signal SCAN1 is a low level signal, the second scanning signal SCAN2 and the light emission control signal Emit are high level signals. In this case, the storage cell reset transistor M5 is turned on. Taking the first row of pixel driving units as an example, a reference voltage signal Vref is applied to the second electrode plate of the storage capacitor Cst via the storage cell reset transistor M5. That is, a potential of a first node N1 (i.e., a metal part N1) is the reference voltage Vref. In this case, a potential of the gate electrode G3 of the driving transistor M3 is also the reference voltage Vref.

In the data signal voltage writing stage, the second scanning signal SCAN2 is a low level signal, the first scanning signal SCAN1 and the light-emitting control signal Emit are high level signals. In this case, the data signal writing transistor M2 and the additional transistor M4 are turned on. Simultaneously, the potential of the gate electrode G3 of the driving transistor M3 is the reference voltage Vref, which is also in the low level, and the driving transistor M3 is also turned on. A data signal Vdata on the data line 11 is applied to the first node N1 via the data signal writing transistor M2, the driving transistor M3 and the additional transistor M4, and the potential of the first node N1 is gradually pulled up by the potential of the data line 11. When the gate electrode voltage of the driving transistor M3 is pulled up to such an extent that a voltage difference between the gate electrode voltage of the driving transistor M3 and the source of the driving transistor M3 is less than or equal to a threshold voltage Vth of the driving transistor M3, the driving transistor M3 will be in the off state. Since the source electrode of the driving transistor M3 is electrically connected to the data line 11 via the data signal writing transistor M2, the potential of the source electrode of the driving transistor M3 is maintained to be $V_{data}$. Thus, when the driving transistor M3 is turned off, the potential of the gate electrode G3 of the driving transistor M3 is $V_{data}-|V_{th}|$, where $V_{data}$ is the voltage on the data line and $|V_{th}|$ is the threshold voltage of the driving transistor M3.

At the moment, a voltage difference Vc between the first electrode plate and the second electrode plate of the storage capacitor Cst is:

$$Vc=V1-V2=V_{PVDD}-(V_{data}-|V_{th}|)$$

V1 denotes the potential of the first electrode plate, V2 denotes the potential of the second electrode plate, and $V_{PVDD}$ denotes a voltage value of the power resource signal.

In the data signal voltage writing stage, the voltage difference Vc between the first electrode plate and the second electrode plate of the storage capacitor Cst includes the threshold voltage $|V_{th}|$ of the driving transistor M3. That is, in the data signal voltage writing stage, the threshold voltage $|V_{th}|$ of the driving transistor M3 is detected and stored in the storage capacitor Cst.

In the data signal voltage writing stage, the light-emitting reset transistor T7 is also turned on, and the potential Vref of the reference voltage signal is applied to the anode 721 of the light-emitting element 72 though the light-emitting reset transistor T7, a potential of the anode of the light-emitting element 72 is initialized to decrease the influence of the voltage of the anode of the light-emitting element 72 in a previous frame on the voltage of the anode of the light-emitting element in a next frame, which further improves the display homogeneity.

In the light-emitting stage, the light-emitting control signal Emit is in a low level, the first scanning signal Scan1 and the second scanning signal Scan2 are in a high-level. In this case, the first light-emitting control transistor M1 and the second light-emitting control transistor M6 are turned on, the voltage of the source electrode of the driving transistor M3 is $V_{PVDD}$, and a voltage difference between the source electrode and the gate electrode of the driving transistor M3 is:

$$V_{sg}=V_{PVDD}-(V_{data}-|V_{th}|)$$

The drain current of the driving transistor M3 drives the organic light-emitting element 72 to emit light, and the drain current $I_d$ of the driving transistor M3 satisfies the following formula:

$$\begin{aligned} I_d &= \frac{1}{2}\mu C_{ox}\frac{W}{L}(V_{sg}-|V_{th}|)^2 \\ &= \frac{1}{2}\mu C_{ox}\frac{W}{L}(V_{PVDD}-V_{data}+|V_{th}|-|V_{th}|)^2 \\ &= \frac{1}{2}\mu C_{ox}\frac{W}{L}(V_{PVDD}-|V_{data}|)^2 \end{aligned}$$

μ denotes a carrier mobility of the driving transistor M3, W and L are respectively a length and a width of a channel of the first light-emitting control transistor M1 and the second light-emitting control transistor M6, $C_{ox}$ denotes a capacitance per unit area of a gate oxide layer of the driving transistor M3, $V_{PVDD}$ is a voltage value in the first power signal line 151, and $V_{DATA}$ is a voltage value on the data line 11.

The working principle of the display stage of the 7T1C pixel driving circuit is as described above. The non-display stage may include a first detection stage and a second detection stage, which are configured to detect the data signal and the output signal of the pixel driving circuit.

In the first detection stage, the detection signal SCAN4 is at a low level, and the first detection transistor M8 is turned on, i.e., step S311 of the driving method is performed. The detection scanning signal is sent to the first detection scanning signal lines 81 sequentially in the first detection stage. Since the reference data signal is sent to the data line 11 in step S310, the first detection line 21 may detect the actual data signal of the first node 711 of the pixel driving circuit 71, that is, the detection of the data signal is implemented.

In the second detection stage, the detection signal SCAN4 is in a low level, and the first detection transistor M8 is turned on, i.e., step S321 of the driving method is performed. The detection scanning signal is sent to the second detection scanning signal lines 82 sequentially in the second detection stage. Since the reference data signal is sent to the data line 11 in step S310, the first detection line 21 may detect the actual data signal of an node N1 of the pixel driving circuit 71, i.e., the detection of the output signal of the pixel driving circuit is implemented.

It is to be noted that since the pixel driving circuit 71 also needs to be turned on in the second detection stage to provide an output signal to the organic light emitting element 72, the second detection stage is set in the display stage. That is, in the actual light-emitting display process, the detection scanning signal is sent to the second detection scanning signal line 82, so that the second compensation detection circuit 32 detects the output signal of the pixel driving circuit 71 to compensate the working performance change of the pixel driving circuit 71.

Figure 13:
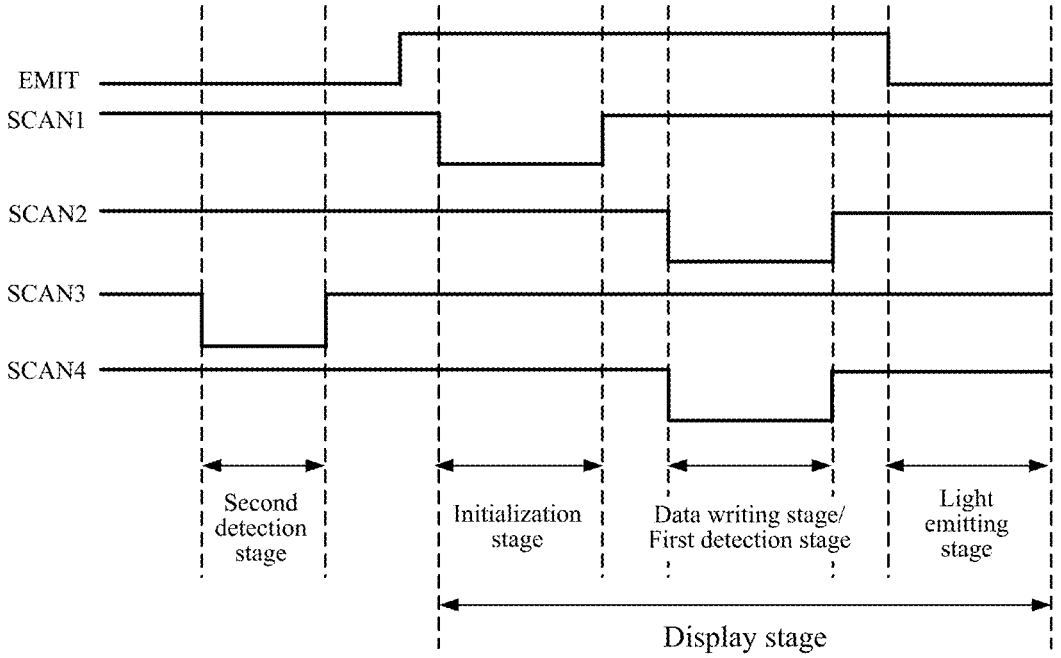
FIG. 13 is a timing sequence diagram of another driving method of the circuit structure shown in FIG. 11.

Based on this, to shorten the detection period without affecting a normal state of the organic light emitting display device, an embodiment of the present disclosure also provides another method for controlling the timing sequence. FIG. 13 is a timing sequence diagram of a driving method of a circuit structure shown in FIG. 11. Referring to FIGS. 8, 11 and 13, unlike the timing sequence diagram of the driving method shown in FIG. 12, the first detection stage may be configured in the data writing stage of the display stage. In the data writing stage of the display stage, since the data signal is provided on the data line 11, the data signal may serve as the reference data signal. At the same time, the detection signal SCAN4 is in a low level, and the first detection transistor M8 is turned on, i.e., step S311 of the driving method is performed. The detection scanning signal is sent to the first detection scanning signal lines 81 sequentially in the first detection stage. Since the reference data signal is sent to the data line 11, the first detection line 21 can detect the actual data signal of the first node 711 of the pixel driving circuit 71, i.e., the detection of the data signal is implemented.

Figure 21:
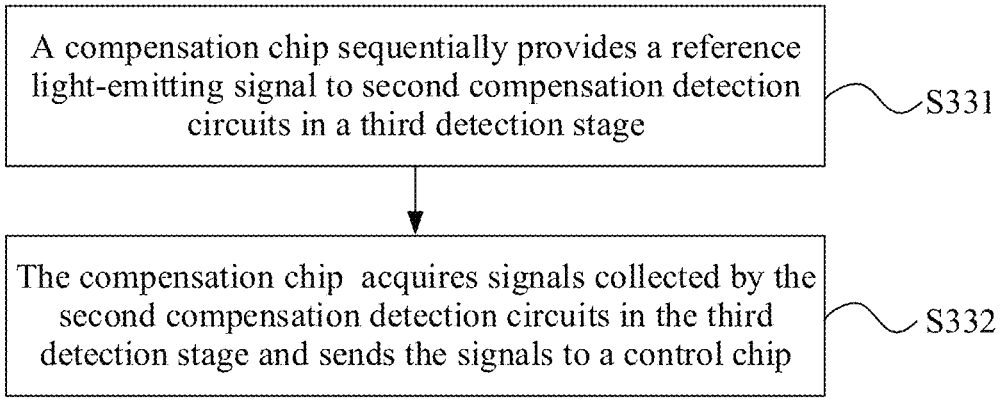
FIG. 21 is a flowchart of another driving method of an organic light emitting display device according to an embodiment of the present disclosure.

In addition to the output compensation due to the working performance change of the pixel driving circuit 71 involved in the above embodiments, the organic light emitting element 72 will gradually age over time, resulting in working characteristic changes of the organic light emitting element 72. When the organic light emitting element 72 is driven with the initial data signal, the brightness of the organic light emitting element 72 changes. Based on this, in the driving method of the organic light-emitting display device provided by the embodiment of the present disclosure, before the step S340 in which the control chip 60 determines a data signal compensation parameter according to the signals collected by the multiple first detection lines 21 in the first detection stage and the signals collected by the multiple first detection lines 21 in the second detection stage, and controls the display driving chip 40 to provide the display data signal to the multiple the data lines 11 in the display stage according to the data signal compensation parameter, referring to FIG. 21, the method may further include the steps described below.

In S331, the compensation chip 50 sequentially provides the reference light-emitting signal to the second compensation detection circuits 32 in the third detection stage.

In S332, the compensation chip 50 acquires signals collected by the second compensation detection circuits 32 in the third detection stage and sends the signals to the control chip 60.

In the above-mentioned process of providing the reference light-emitting signal to the second compensation detection circuits 32, it does not need to drive the pixel driving circuit 71. The reference light-emitting signal alone drives the organic light-emitting element 72 and obtains a feedback signal from the organic light-emitting element 72. The working curve of the organic light-emitting element 72 may be determined according to the feedback signal, and the data signal compensation parameter of the organic light-emitting element 72 may be determined according to the change of the working curve, to perform compensation in the actual driving display process. The reference light-emitting signal here may be a reference voltage signal to obtain a working current of the organic light-emitting element, or a reference current signal to obtain a working voltage of the organic light-emitting element. In some embodiments, the specific type and value of the reference light-emitting signal may be configured according to actual needs, which are not limited here.

Figure 14:
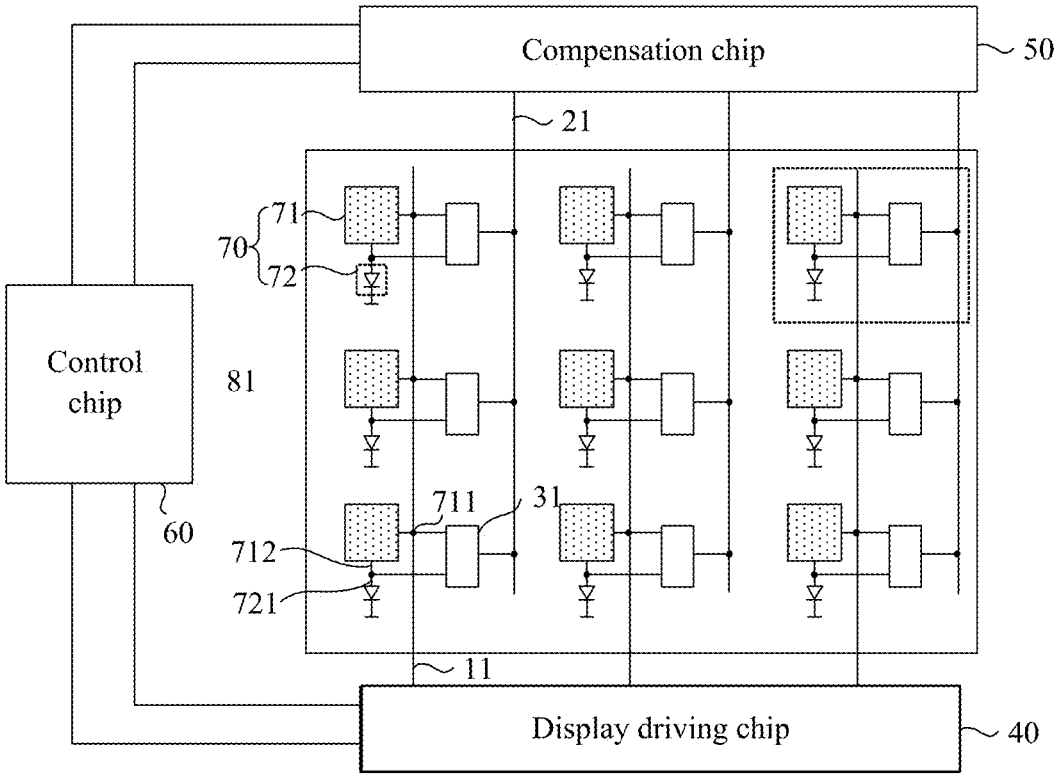
FIG. 14 is a structural diagram of another organic light emitting display device according to an embodiment of the present disclosure.

In one or more embodiments, an organic light emitting display device is further provided. FIG. 14 is a structural diagram of another organic light emitting display device according to an embodiment of the present disclosure. Referring to FIG. 14, in the organic light emitting display device, the first compensation detection circuits 31 in the first compensation detection circuit group 310 are electrically connected to the first nodes 711 of the pixel driving circuits 71 in the same column in one-to-one correspondence, and each pixel unit 70 includes a pixel driving circuit 71 and an organic light emitting element 72. An output end 712 of the pixel driving circuit 71 is electrically connected to an anode 721 of the organic light emitting element 72. Multiple first compensation detection circuit 31 are electrically connected to output ends of the multiple pixel driving circuits 71 in one-to-one correspondence.

The detection stage includes a first detection stage and a second detection stage. The compensation chip 50 is configured to acquire the signals collected by the multiple first detection lines 21 in the first detection stage and send the signals to the control chip 60. The compensation chip 50 is further configured to acquire the signals collected by the multiple first detection lines 21 in the second detection stage and send the signals to the control chip 60. The control chip 60 is configured to acquire the signals collected by the multiple first detection lines 21 in the first detection stage and acquire the signals collected by the multiple first detection lines 21 in the second detection stage to determine the data signal compensation parameter, and control the display driving chip 40 to provide the display data signal to the multiple the data lines 11 in the display stage according to the data signal compensation parameter.

Figure 15:
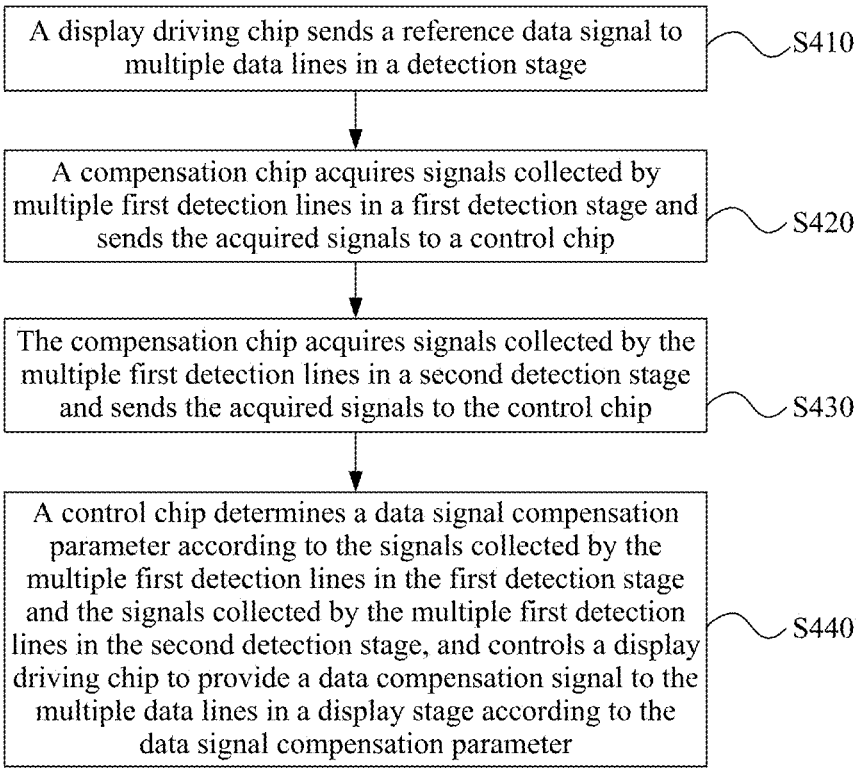
FIG. 15 is a flowchart of another driving method of an organic light emitting display device according to an embodiment of the present disclosure.
Figure 22:
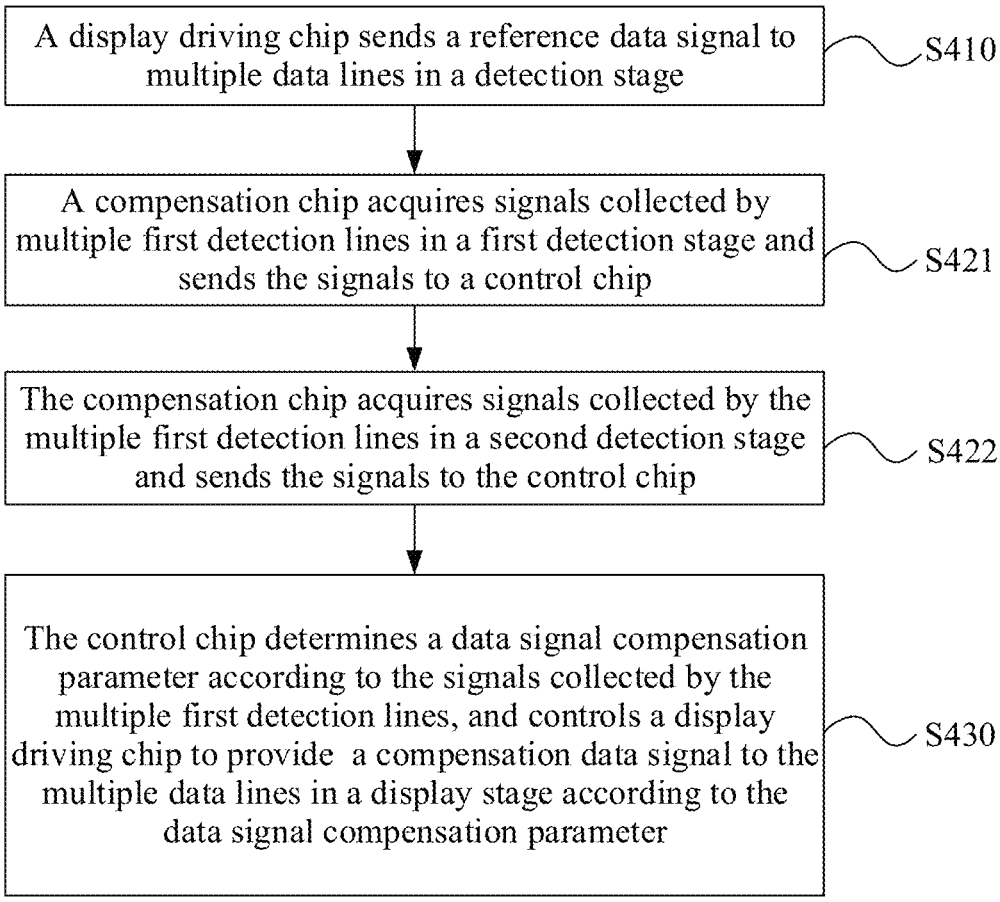
FIG. 22 is a flowchart of another driving method of an organic light emitting display device according to an embodiment of the present disclosure.

For the organic light emitting display device shown in FIG. 14, an embodiment of the present disclosure further provides a driving method of the organic light emitting display device. FIG. 15 is a flowchart of a driving method of an organic light emitting display device according to an embodiment of the present disclosure. Referring to FIGS. 14, 15 and 22, the driving method includes the steps described below.

In S410, the display driving chip 40 sends a reference data signal to multiple data lines 11 in the detection stage.

In S421, the compensation chip 50 acquires signals collected by the multiple first detection lines 21 in the first detection stage and sends the signals to the control chip 60.

In S422, the compensation chip 50 acquires signals collected by the multiple first detection lines 21 in the second detection stage and sends the signals to the control chip 60.

In S430, the control chip 60 determines a data signal compensation parameter according to the signals collected by the multiple first detection lines 21, and controls the display driving chip 40 to provide a compensation data signal to the multiple data lines 11 in a display stage according to the data signal compensation parameter.

Referring to FIGS. 14 and 15, the first compensation detection circuit 31 is connected to both of the first node 711 and the output end 712 of the pixel driving circuit 71, so that the actual data signal of the first node 711 and the actual output signal of the output end 712 are obtained in the first detection stage and the second detection stage respectively in the time division manner, so that the data signal compensation parameter is determined by the control chip 60 and the data signal of the pixel driving circuit is compensated in the display stage. In this case, the first compensation detection circuits 31 and the pixel driving circuits 71 are in one-to-one correspondence, which may ensure accurate compensation for each pixel driving circuit 71, and ensure that the brightness of each pixel unit has a uniform gray standard, to ensure the display quality of organic light emitting display device. Meanwhile, the first compensation detection circuits 31 in the same column are connected to the same first detection line 21, which may reduce the wiring density of the detection lines, help to increase the line width and pitch, and may reduce mutual interference between signal lines to a certain extent.

Figure 16:
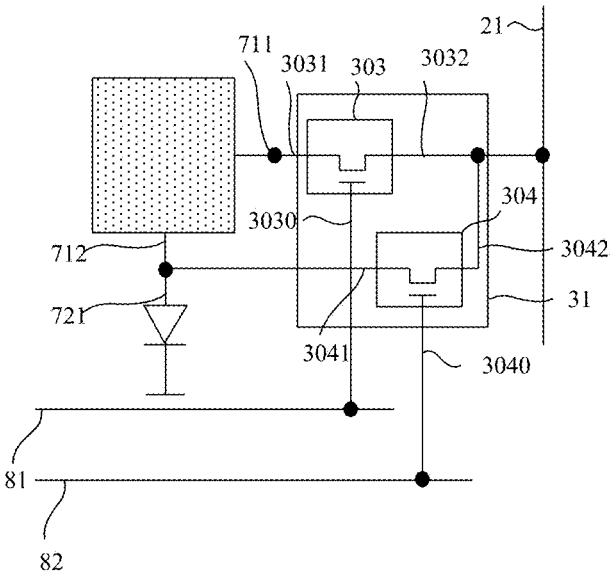
FIG. 16 is an enlarged view of a part of an organic light emitting display device in a dotted box shown in FIG. 14.

As described above, the first compensation detection circuit can perform time division detection by setting two switch units. FIG. 16 is a partially enlarged view of a dotted box of an organic light emitting display device shown in FIG. 14. Referring to FIGS. 14 and 16, the organic light emitting display device further includes multiple third detection scanning signal lines 83 and multiple fourth detection scanning signal lines 84. The first compensation detection circuit 31 includes a third switch unit 303 and a fourth switch unit 304.

Control ends 3031 of the third switch units 303 of the first compensation detection circuits 31 in a same row are connected to a same third detection scanning signal line 83, and control ends 3041 of the fourth switch units 304 of the first compensation detection circuits 31 in a same row are connected to a same fourth detection scanning signal line 84. An input end 3032 of the third switch unit 303 is electrically connected to the first node 711, and an input end 3042 of the fourth switch unit 304 is electrically connected to the output end 712 of the pixel driving circuit 71. An output end 3033 of the third switch unit 303 and an output end 3043 of the fourth switch unit 304 are electrically connected and electrically connected to the first detection line 21.

When the detection scanning signal is sent to the third switch unit 303, the first compensation detection circuit 31 in the corresponding row may be turned on to realize the signal detection of the first nodes 711 of the pixel driving circuits 71 in each row. When the detection scanning signal is sent to the third switch unit 304, the first compensation detection circuit 31 in the corresponding row may be turned on to realize the signal detection of the output ends 712 of the pixel driving circuits 71 in each row. The third switch unit 303 and the fourth switch unit 304 may be thin film transistors. The connection between the first node 711 of the pixel driving circuit 71 and the first detection line 21 is controlled by the third switch unit 303, and thus the actual data signal of the first node 711 can be detected by the compensation chip 50. Similarly, with the fourth switch unit 304, the compensation chip 50 can detect the actual output signal of the output end 712 of the pixel driving circuit 71.

Figure 17:
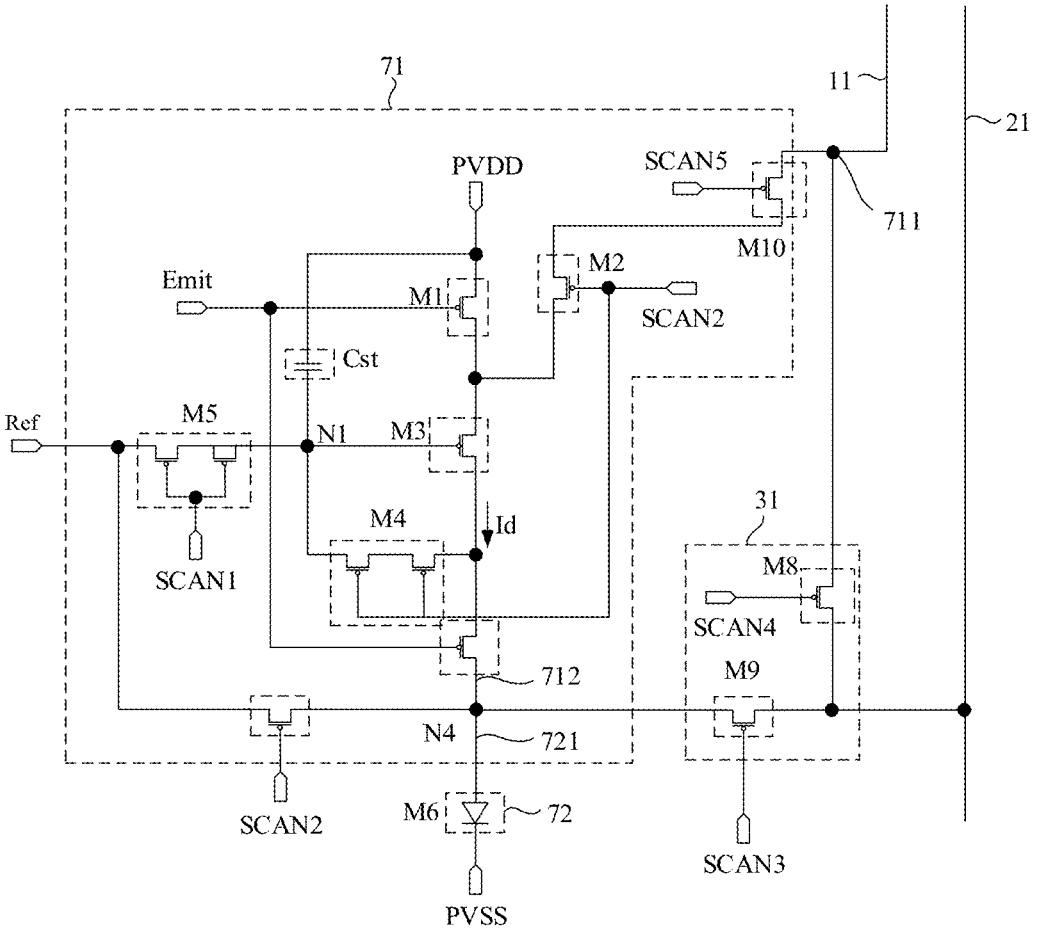
FIG. 17 is a circuit diagram of the dotted box shown in FIG. 14.
Figure 18:
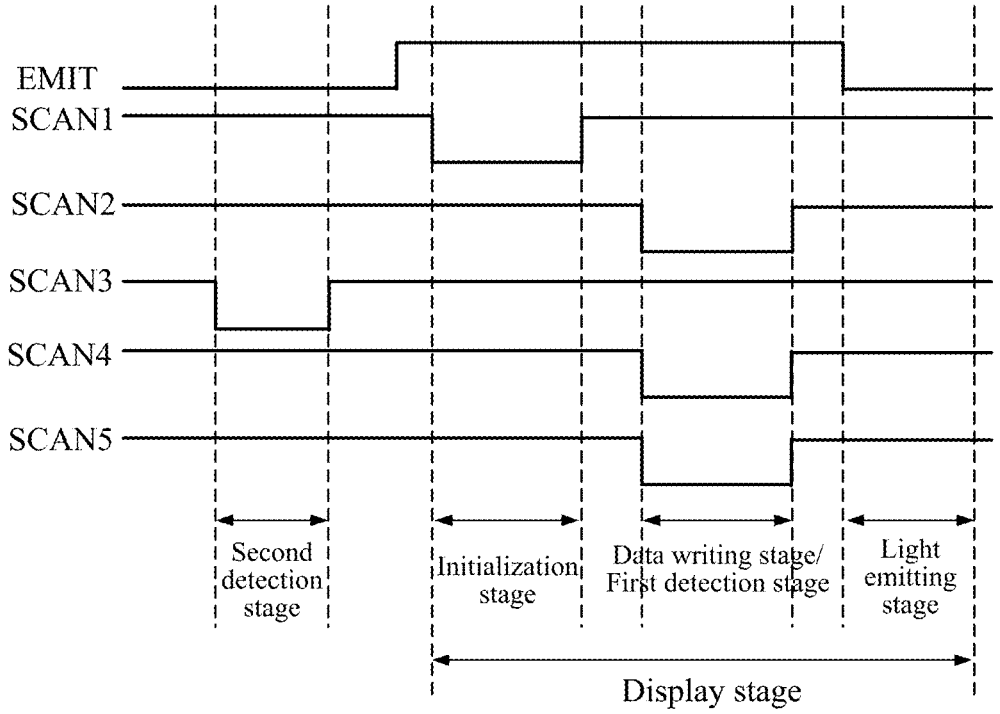
FIG. 18 is a timing sequence diagram of a driving method of a circuit structure shown in FIG. 17.

FIG. 17 is a circuit diagram of a dotted box shown in FIG. 14. As shown in FIG. 17, the first detection circuit 31 includes a first detection transistor M8 and a second detection transistor M9. "SCAN3" denotes a first scanning signal provided by the first detection scanning line 81, and "SCAN4" denotes a second scanning signal provided by the second detection scanning line 82. In addition, to avoid interference to the pixel driving circuit in the detection process and effectively control the pixel driving circuit, the pixel driving circuit 71 shown in FIG. 17 further includes a second data signal writing transistor M10. FIG. 18 is a timing sequence diagram of a driving method of the circuit structure shown in FIG. 17. Referring to FIGS. 14, 17 and 18, the driving principle of the organic light emitting display device is described with a 7T1C pixel driving circuit as an example. Similarly, the working principle of the organic light-emitting display device is described in details with an example in which the transistors M1 to M10 are P-type transistors, and the reference voltage signal Vref is at a low level in the first detection stage of the non-display stage.

The timing sequence and working principle of the pixel driving circuit 71 in the display stage are as described above, and the timing sequence process of the first detection stage that is set in the non-display stage in the driving process of the organic light-emitting display device is also described above, which will not be repeated here. The difference between the organic light-emitting display device and the circuit structure shown in FIG. 14 and those shown in FIG. 17 in the working process is as follows.

In the data writing stage of the display stage, the scanning signal SCAN5 is in a low level, the second data signal writing transistor M10 is turned on, and the data signal Vdata on the data line 11 is applied to the source electrode of the data signal writing transistor M2 through the second data signal writing transistor M10. In this case, the detection signal SCAN4 may be configured to a low level, the first detection transistor M8 is turned on, and the first detection line 21 may detect the actual data signal of the first node 711 of the pixel driving circuit 71. In this way, the detection of the data signal is implemented, i.e., the first detection stage is moved to the data writing stage of the display stage.

In the second detection stage, the detection signal SCAN4 is in a low level, and the first detection transistor M8 is turned on. That is, step S321 of the driving method is performed, and the detection scan signal is sent to the second detection scanning signal lines 82 sequentially in the second detection stage. Since the reference data signal is sent to the data line 11 in step S310, the first detection line 21 can detect the actual data signal of an node N1 of the pixel driving circuit 71, i.e., the detection of the output signal of the pixel driving circuit is implemented.

What is claimed is:

1. An organic light emitting display device, comprising:

a plurality of data lines, a plurality of first detection lines, a plurality of first compensation detection circuits, a display driving chip, a compensation chip, a control chip, and a plurality of pixel units arranged in an array;

wherein each of the plurality of data lines is electrically connected to a respective one of the plurality of first detection lines through at least one of the plurality of first compensation detection circuits;

the plurality of data lines are electrically connected to the display driving chip, the plurality of first detection lines are electrically connected to the compensation chip, and the control chip is electrically connected to the display driving chip and the compensation chip separately;

the display driving chip is configured to provide a reference data signal to the plurality of data lines in a detection stage; and the compensation chip is configured to acquire signals collected by the plurality of first detection lines and send the acquired signals to the control chip in the detection stage, and the control chip is configured to determine a data signal compensation parameter according to the signals collected by the plurality of first detection lines, and control the display driving chip to send a display data signal to the plurality of data lines in a display stage according to the data signal compensation parameter; and wherein each of the plurality of pixel units comprises a pixel drive circuit and an organic light emitting element;

the pixel drive circuits of the pixel units in a same column are electrically connected to a same one of the plurality of data lines, and a connection node of the pixel drive circuit and the data line is a first node; and the plurality of first compensation detection circuits are arranged in an array, the first compensation detection circuits in a same column are a first compensation detection circuit group; each first compensation detection circuit in the first compensation detection circuit group is electrically connected to the first node of the pixel drive circuit which is in a same column but a different row as the first compensation detection circuit.

2. The organic light emitting display device of claim 1, further comprising a plurality of first detection scanning signal lines;

the first compensation detection circuit comprises a first switch unit; control ends of the first switch units of the first compensation detection circuits in a same row are connected to a same first detection scanning signal line; an input end of the first switch unit is electrically connected to the first node; an output end of the first switch unit is electrically connected to the first detection line.

3. The organic light emitting display device of claim 1, wherein each of the plurality of pixel units comprises the pixel drive circuit and the organic light emitting element; an output terminal of the pixel drive circuit is electrically connected to an anode of the organic light emitting element;

the pixel drive circuits of the pixel units in the same column are electrically connected to the same data line;

the organic light emitting display device further comprises a plurality of second compensation detection circuits and a plurality of second detection lines;

output ends of the plurality of pixel drive circuits are electrically connected to first ends of the plurality of second detection lines in one-to-one correspondence;

second ends of second compensation detection circuits electrically connected to the output ends of the pixel drive circuits in the same column are connected to a same second detection line;

the plurality of second detection lines are electrically connected to the compensation chip; the compensation chip is further configured to acquire signals collected by the plurality of second detection lines in the detection stage and send the signals to the control chip; the control chip is configured to determine the data signal compensation parameter according to the signals collected by the first detection lines and the plurality of the second detection lines, and control the display driving chip to provide the display data signal to the plurality of data lines according to the data signal compensation parameter in the display stage.

4. The organic light emitting display device of claim 3, further comprising a plurality of second detection scanning signal lines;

each of the plurality of second compensation detection circuits comprises a second switch unit; control ends of the second switch units of the second compensation detection circuits in a same row are connected to a same second detection scanning signal line; a first end of the second switch unit is a first end of the second compensation detection circuit; and a second end of the second switch unit is a second end of the second compensation detection circuit.

5. The organic light emitting display device of claim 1, wherein each of the plurality of pixel units comprises the pixel drive circuit and the organic light emitting element; an output terminal of the pixel drive circuit is electrically connected to an anode of the organic light emitting element;

the pixel drive circuits of the pixel units in the same column are electrically connected to the same data line;

the organic light emitting display device further comprises a plurality of second compensation detection circuits, output ends of the plurality of pixel drive circuits are electrically connected to first ends of the plurality of second detection lines in one-to-one correspondence;

second ends of second compensation detection circuits electrically connected to the output ends of the pixel drive circuits in the same column are connected to a same first detection line;

the detection stage comprises a first detection stage and a second detection stage;

the compensation chip is configured to acquire the signals collected by the plurality of first detection lines in the first detection stage and send the signals to the control chip;

the compensation chip is configured to acquire the signals collected by the plurality of first detection lines in the second detection stage and send the signals to the control chip;

the control chip is configured to acquire the signals collected by the plurality of first detection lines in the first detection stage and acquire the signals collected by the plurality of first detection lines in the second detection stage to determine the data signal compensation parameter, and control the display driving chip to provide the display data signal to the plurality of the data lines in the display stage according to the data signal compensation parameter.

6. The organic light emitting display device of claim 1, wherein the first compensation detection circuits in the first compensation detection circuit group are electrically connected to the first nodes of the pixel drive circuits in in the same column in one-to-one correspondence;

each pixel unit comprises the pixel drive circuit and the organic light emitting element; an output end of the pixel drive circuit is electrically connected to an anode of the organic light emitting element;

the plurality of first compensation detection circuits are electrically connected to the output ends of the plurality of pixel drive circuits in one-to-one correspondence;

the detection stage comprises a first detection stage and a second detection stage;

the compensation chip is configured to acquire the signals collected by the plurality of first detection lines in the first detection stage and send the signals to the control chip;

the compensation chip is configured to acquire the signals collected by the plurality of first detection lines in the second detection stage and send the signals to the control chip;

the control chip is configured to acquire the signals collected by the plurality of first detection lines in the first detection stage and acquire the signals collected by the plurality of first detection lines in the second detection stage to determine the data signal compensation parameter, and control the display driving chip to provide the display data signal to the plurality of the data lines in the display stage according to the data signal compensation parameter.

7. The organic light emitting display device of claim 6, further comprising a plurality of third detection scanning signal lines and a plurality of fourth detection scanning signal lines; the first compensation detection circuit comprises a third switch unit and a fourth switch unit;

control ends of the third switch units of the first compensation detection circuits in a same row are connected to a same third detection scanning signal line, and control ends of the fourth switch units of the first compensation detection circuits in the same row are connected to a same fourth detection scanning signal line; an input end of the third switch unit is electrically connected to the first node, and an input end of the fourth switch unit is electrically connected to the output end of the pixel drive circuit; output ends of the third switch unit and the fourth switch unit are electrically connected and electrically connected to the first detection line.

8. A drive method of an organic light emitting display device, wherein the organic light emitting display device comprises a plurality of data lines, a plurality of first detection lines, a Plurality of first compensation detection circuits, a display driving chip, a compensation chip, a control chip, and a plurality of pixel units arranged in an array;

wherein each of the plurality of data lines is electrically connected to a respective one of the plurality of first detection lines through at least one of the plurality of first compensation detection circuits; and the plurality of data lines are electrically connected to the display driving chip, the plurality of first detection lines are electrically connected to the compensation chip, and the control chip is electrically connected to the display driving chip and the compensation chip separately; and wherein each of the plurality of pixel units comprises a pixel drive circuit and an organic light emitting element;

the pixel drive circuits of the pixel units in a same column are electrically connected to a same one of the plurality of data lines, and a connection node of the pixel drive circuit and the data line is a first node; and the plurality of first compensation detection circuits are arranged in an array, the first compensation detection circuits in a same column are a first compensation detection circuit group; each first compensation detection circuit in the first compensation detection circuit group is electrically connected to the first node of the pixel drive circuit which is in a same column but a different row as the first compensation detection circuit; and wherein the method comprises:

providing, by the display driving chip, a reference data signal to the plurality of data lines in a detection stage;

acquiring, by the compensation chip, signals collected by the plurality of first detection lines in the detection stage and send the signals to the control chip; and determining, by the control chip, a data signal compensation parameter according to the signals collected by the plurality of first detection lines, and controlling the display driving chip to provide a compensation data signal to the plurality of data lines in a display stage according to the data signal compensation parameter.

9. The drive method of claim 8, wherein the organic light emitting display device further comprises a plurality of first detection scanning signal lines;

each of the plurality of first compensation detection circuits comprises a first switch unit; control ends of the first switch units of the first compensation detection circuits in a same row are connected to a same first detection scanning signal line; input ends of the first switch units are electrically connected to the first nodes; output ends of the first switch units are electrically connected to the first detection line;

acquiring, by the compensation chip, the signals collected by the plurality of first detection lines in the detection stage and send the signals to a control chip comprises:

providing a detection scanning signal to each of the plurality of first detection scanning signal lines in sequence in the detection stage;

acquiring, by the compensation chip signals, signals collected by each of the plurality of first detection lines sequentially and sending the signals to the control chip.

10. The drive method of claim 8, wherein each pixel unit comprises the pixel drive circuit and the organic light emitting element; an output end of the pixel drive circuit is electrically connected to an anode of the organic light emitting element;

the pixel drive circuits of the pixel units in the same column are electrically connected to the data line;

the organic light emitting display device further comprises a plurality of second compensation detection circuits and a plurality of second detection lines;

output ends of the plurality of pixel drive circuits are electrically connected to first ends of the plurality of second detection lines in one-to-one correspondence;

second ends of second compensation detection circuits electrically connected to the output ends of the pixel drive circuits in the same column are connected to a same second detection line;

the plurality of second detection lines are electrically connected to the compensation chip;

the drive method further comprises:

acquiring, by the compensation chip, the signals collected by the plurality of second detection lines in the detection stage and send the signals to a control chip; and determining, by the control chip, the data signal compensation parameter according to the signals collected by the plurality of first detection lines, and controlling the display driving chip to provide the compensation data signal to the plurality of data lines in the display stage according to the data signal compensation parameter comprises:

determining, by the control chip, a data signal compensation parameter according to the signals collected by the first detection lines and the plurality of second detection lines, and controlling the display driving chip to provide a display data signal to the plurality of data lines in the display stage according to the data signal compensation parameter.

11. The drive method of claim 10, wherein the organic light emitting display device further comprises a plurality of second detection scanning signal lines;

each of the plurality of second compensation detection circuits comprises a second switch unit; control ends of the second switch units of the second compensation detection circuits in a same row are connected to a same second detection scanning signal line; a first end of the second switch unit is a first end of the second compensation detection circuit; and a second end of the second switch unit is a second end of the second compensation detection circuit;

the method further comprises:

providing a detection scanning signal to each of the plurality of second detection scanning signal lines in sequence in the detection stage.

12. The drive method of claim 11, wherein the detection stage comprises a third detection stage; the method further comprises:

providing, by the compensation chip, a reference light emitting signal to the second compensation detection circuit sequentially in the third detection stage;

acquiring, by the compensation chip, the signals collected by the plurality of second compensation detection circuits in the third detection stage and sending the signals to the control chip.

13. The drive method of claim 8, wherein each pixel unit comprises the pixel drive circuit and the organic light emitting element; the output end of the pixel drive circuit is electrically connected to an anode of the organic light emitting element;

the pixel drive circuits of the pixel units in the same column are electrically connected to the data line;

the organic light emitting display device further comprises a plurality of second compensation detection circuits output ends of the plurality of pixel drive circuits are electrically connected to first ends of the plurality of second detection lines in one-to-one correspondence;

second ends of second compensation detection circuits electrically connected to the output ends of the pixel drive circuits in the same column are connected to a same first detection line;

the detection stage comprises a first detection stage and a second detection stage;

acquiring, by the compensation chip, the signals collected by the plurality of first detection lines in the detection stage and send the signals to a control chip comprises:

acquiring, by the compensation chip, the signals collected by the plurality of first detection lines in the first detection stage and send the signals to the control chip;

acquiring, by the compensation chip, the signals collected by the plurality of first detection lines in the second detection stage and send the signals to the control chip;

determining, by the control chip, the data signal compensation parameter according to the signals collected by the plurality of first detection lines, and controlling the display driving chip to provide the compensation data signal to the plurality of data lines in the display stage according to the data signal compensation parameter comprises:

acquiring, by the control chip, the signals collected by the plurality of first detection lines in the first detection stage and acquire the signals collected by the plurality of first detection lines in the second detection stage to determine the data signal compensation parameter, and controlling the display driving chip to provide the display data signal to the plurality of the data lines in the display stage according to the data signal compensation parameter.

14. The drive method of claim 8, wherein each of the plurality of first compensation detection circuits in the first compensation detection circuit group is electrically connected to the first node of the pixel drive circuit which is in a same column but a different row as the first compensation detection circuit in one-to-one correspondence;

each pixel unit comprises the pixel drive circuit and the organic light emitting element; an output end of the pixel drive circuit is electrically connected to an anode of the organic light emitting element;

the plurality of first compensation detection circuits are electrically connected to the output ends of the plurality of pixel drive circuits in one-to-one correspondence;

the organic light emitting display device further comprises a plurality of third detection scanning signal lines and a plurality of third detection scanning signal lines; each first compensation detection circuit comprises a third switch unit and a fourth switch unit;

control ends of the third switch units of the first compensation detection circuits in a same row are connected to a same third detection scanning signal line, and control ends of the fourth switch units of the first compensation detection circuits in the same row are connected to a same fourth detection scanning signal line; an input end of the third switch unit is electrically connected to the first node, and an input end of the fourth switch unit is electrically connected to the output end of the pixel drive circuit; output ends of the third switch unit and the fourth switch unit are electrically connected and electrically connected to the first detection line;

the detection stage comprises a first detection stage and a second detection stage;

acquiring, by the compensation chip, the signals collected by the plurality of first detection lines in the detection stage and send the signals to a control chip comprises:

acquiring, by the compensation chip, the signals collected by the plurality of first detection lines in the first detection stage and send the signals to the control chip; and acquiring, by the compensation chip, the signals collected by the plurality of first detection lines in the second detection stage and send the signals to the control chip.

* * * * *